US006436616B1

(12) United States Patent
Geisler et al.

(10) Patent No.: US 6,436,616 B1
(45) **Date of Patent: *Aug. 20, 2002**

(54) PHOTOTHERMOGRAPHIC ELEMENT WITH REDUCED WOODGRAIN INTERFERENCE PATTERNS

(75) Inventors: Thomas C. Geisler, Cottage Grove; Thomas J. Kub, Stillwater; Darlene F. Stewart, Mahtomedi; Paul C. Schubert, Marine on St. Croix; James C. Vanous, Roseville; Mark C. Skinner, Afton, all of MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/550,007

(22) Filed: Apr. 14, 2000

Related U.S. Application Data

(63) Continuation-in-part of application No. 08/340,233, filed on Nov. 16, 1994.

(51) Int. Cl.[7] ..... G03C 1/498; G03C 1/815

(52) U.S. Cl. ..... 430/350; 496/510; 496/523; 496/619; 496/944; 496/950; 496/961

(58) Field of Search ..... 430/617, 619, 430/567, 523, 450, 944, 961, 203, 350, 510, 496

(56) References Cited

U.S. PATENT DOCUMENTS

| | | | |
|---|---|---|---|
| 3,856,526 | A | 12/1974 | Hamb et al. |
| 3,909,271 | A | 9/1975 | Ikenoue et al. |
| 4,161,408 | A | 7/1979 | Winslow et al. |
| 4,435,499 | A | 3/1984 | Reeves |
| 4,711,838 | A | 12/1987 | Grzeskowiak et al. |
| 4,725,534 | A | 2/1988 | Kagami et al. |
| 4,752,559 | A | 6/1988 | Helland et al. |
| 4,835,096 | A | 5/1989 | Lea |
| 4,839,265 | A | 6/1989 | Ohno et al. |
| 4,871,656 | A | 10/1989 | Parton et al. |
| 4,882,265 | A | 11/1989 | Laganis et al. |
| 4,904,557 | A | 2/1990 | Kubo |
| 5,104,777 | A | 4/1992 | Schmidt et al. |
| 5,135,842 | A | 8/1992 | Kitchin et al. |
| 5,196,300 | A | 3/1993 | Urabe et al. |
| 5,258,282 | A | 11/1993 | Kagami et al. |
| 5,393,649 | A | 2/1995 | Bauer et al. |
| 5,468,603 | A | 11/1995 | Kub |

FOREIGN PATENT DOCUMENTS

| | | |
|---|---|---|
| EP | 0 251 282 A2 | 6/1987 |
| EP | 0 473 292 A2 | 3/1992 |
| EP | 0 523 465 A1 | 7/1992 |
| EP | 0 559 228 A1 | 3/1993 |
| EP | 0 627 660 | 12/1996 |
| FR | 2 075 076 | 9/1971 |

OTHER PUBLICATIONS

Electrophotographic Laser Copier Printer Scanner,: SPIE, vol. 390, (1983), by W. I. Imaino, et al IBM Research Laboratory.

*Primary Examiner*—Thorl Chea
(74) *Attorney, Agent, or Firm*—J Lanny Tucker

(57) ABSTRACT

The present invention provides a spectrally sensitized photothermographic silver halide element comprising a support layer having on at least one surface thereof a photothermographic composition which displays uniform image density across its surface when exposed to floodlight or uniform incandescent light exposure at radiation wavelengths to which the element is sensitive, said element comprising at least two layers, including a top layer and a photothermographic emulsion layer, said photothermographic emulsion layer comprising a binder, a light insensitive silver source, a reducing agent for silver ion and infrared radiation sensitive silver halide grains, wherein the coherent radiation is rendered more diffuse in its passage through the element than when it strikes the top layer. This may be accomplished at least in part by 1) the top layer of the element having haze induced therein of 0.05 to 306 by surface modification of that layer, 2) there being a random refractive pattern on the top layer, 3) haze being induced in the silver halide containing layer, 4) the reflective characteristics of a surface of the support layer facing the photothermographic composition have been altered to reduce reflection of coherent radiation into said composition, and/or 5) having a radiation absorbing material contained within the photothermographic element to decrease light reflected off of the support.

34 Claims, No Drawings

PHOTOTHERMOGRAPHIC ELEMENT WITH REDUCED WOODGRAIN INTERFERENCE PATTERNS

CROSS-REFERENCE TO RELATED APPLICATION

This is a Continuation-In-Part of application Ser. No. 08/340,233, filed Nov. 16, 1994.

BACKGROUND OF THE INVENTION

1. Field of the Invention

This invention relates to radiation sensitized, photothermographic elements composed of a silver halide grain, a reducible silver source, a reducing agent for silver ion, and a binder; and in particular to such photothermographic elements having emulsion coatings providing uniform optical density and which are free of certain types of optical patterns produced by coherent radiation imaging.

2. Background of the Art

The increasing availiblilty and use of semi-conductor light sources, and particularly laser diodes which emit in the visible and particularly in the red and near infrared region of the electromagnetic spectrum, have led to the need for photothermographic materials for medical diagnostic and graphic arts use that have the ability to be efficiently exposed by laser imagesetters, light emitting diodes, or laser imagers and which have the ability to form sharp images of high resolution and sharpness. In addition, semiconductor light sources have allowed the design of compact automated equipment which increases the porductivity of the imaging process, especially in medical diagnostic and graphic arts uses. The goal of photothermographic elements is to eliminate the use of wet processing chemicals and to provide a simpler, environmentally friendly thermal system to the customer.

Silver halide-containing, photothermographic imaging materials (i.e., heat-developable photographic elements) processed with heat, and without liquid development, have been known in-the art for many years. These materials are also known as "dry silver" compositions or emulsions and generally comprise a support having coated thereon: (a) a photosensitive material that generates silver atoms when irradiated; (b) a non-photosensitive, reducible silver source; (c) a reducing agent (i.e., a developer) for silver ion, for example that silver ion in the non-photosensitive, reducible silver source; and (d) a binder.

The photosensitive material is generally photo-graphic silver halide which must be in catalytic proximity to the non-photosensitive, reducible silver source. Catalytic proximity requires an intimate physical association of these two materials so that when silver atoms (also known as silver specks, clusters, or nuclei) are generated by irradiation or light exposure of the photographic silver halide, those nuclei are able to catalyze the reduction of the reducible silver. source. It has long been understood that silver atoms (Ag°) are a catalyst for the reduction of silver ions, and that the photosensitive silver halide can be placed into catalytic proximity with the non-photosensitive, reducible silver source in a number of different fashions. For example, catalytic proximity can be accomplished by partial metathesis of the reducible silver source with a halogen-containing source (see, for example, U.S. Pat. No. 3,457,075); by coprecipitation of silver halide and the reducible silver source material (see, for example, U.S. Pat. No. 3,839,049); and other methods that intimately associate the photosensitive, photographic silver halide and the non-photosensitive, reducible silver source.

The non-photosensitive, reducible silver source is a material that contains silver ions. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. Salts of other organic acids or other organic materials, such as silver imidazolates, have been proposed. U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms (Ag°). The imagewise distribution of these clusters is known in the art as a latent image. This latent image is generally not visible by ordinary means. Thus, the photosensitive emulsion must be further processed to produce a visible image. This is accomplished by the reduction of silver ions which are in catalytic proximity to silver halide grains bearing the clusters of silver atoms, (i.e., the latent image).

In a photothermographic element, the reducing agent for the organic silver salt, often referred to as a "developer," may be any material, preferably any organic material, that can reduce silver ion to metallic silver. At elevated temperatures, in the presence of the latent image, the non-photosensitive reducible silver source (e.g., silver behenate) is reduced by the reducing agent for silver ion. This produces a negative black-and-white image of elemental silver.

While conventional photographic developers such as methyl gallate, hydroquinone, substituted hydroquinones, hindered phenols, catechol, pyrogallol, ascorbic acid, and ascorbic acid derivatives are useful, they tend to result in very reactive photothermographic formulations and fog during preparation and coating of photothermographic elements. As a result, hindered bisphenol reducing agents have traditionally been preferred.

As the visible image in black-and-white photothermographic elements is usually produced entirely by elemental silver (Ag°), one cannot readily decrease the amount of silver in the emulsion without reducing the maximum image density. However, reduction of the amount of silver is often desirable to reduce the cost of raw materials used in the emulsion and/or to enhance performance. For example, toning agents may be incorporated to improve the color of the silver image of the photothermographic element. Another method of increasing the maximum image density in photographic and photothermographic emulsions without increasing the amount of silver in the emulsion layer is by incorporating dye-forming or dye-releasing materials in the emulsion. Upon imaging, the dye-forming or dye-releasing material is oxidized, and a dye and a reduced silver image are simultaneously formed in the exposed region. In this way, a dye-enhanced black-and-white silver image can be produced.

The imaging arts have long recognized that the fields of photothermography and thermography are clearly distinct from that of photography. Photothermographic and thermographic elements significantly differ from conventional silver halide photographic elements which require wet-processing.

In photothermographic and thermographic imaging elements, a visible image is created by heat as a result of the reaction of a developer incorporated within the element.

Heat is essential for development and temperatures of over 100° C. are routinely required. In contrast, conventional wet-processed photographic imaging elements require processing in aqueous processing baths to provide a visible image (e.g., developing and fixing baths) and development is usually performed at a more moderate temperature (e.g., 30°–50° C.).

In photothermographic elements only a small amount of silver halide is used to capture light and a different form of silver (e.g., silver behenate) is used to generate the image with heat. Thus, the silver halide serves as a catalyst for the development of the non-photosensitive, reducible silver source. In contrast, conventional wet-processed black-and-white photographic elements use only one form of silver (e.g., silver halide) which, upon development, is itself converted to the silver image. Additionally, photothermographic elements require an amount of silver halide per unit area that is as little as one-hundredth of that used in a conventional wet-processed silver halide.

Photothermographic systems employ a light-insensitive silver salt, such as silver behenate, which participates with the developer in developing the latent image. In contrast, photographic systems do not employ a light-insensitive silver salt directly in the image-forming process. As a result, the image in photothermographic elements is produced primarily by reduction of the light-insensitive silver source (silver behenate) while the image in photographic black-and-white elements is produced primarily by the silver halide.

In photothermographic and thermographic elements, all of the "chemistry" of the system is incorporated within the element itself. For example, photothermo-graphic and thermographic elements incorporate a developer (i.e., a reducing agent for the non-photo-sensitive reducible source of silver) within the element while conventional photographic elements do not. The incorporation of the developer into photo-thermographic elements can lead to increased formation of "fog" upon coating of photothermographic emulsions as compared to photographic emulsions. Even in so-called instant photography, developer chemistry is physically separated from the silver halide until development is desired. Much effort has gone into the preparation and manufacture of photothermographic and thermographic elements to minimize formation of fog upon coating, storage, and post-processing aging.

Similarly, in photothermographic elements, the unexposed silver halide inherently remains after development and the element must be stabilized against further development. In contrast, the silver halide is removed from photographic elements after development to prevent further imaging (i.e., the fixing step).

In photothermographic and thermographic elements the binder is capable of wide variation and a number of binders are useful in preparing these elements. In contrast, photographic elements are limited almost exclusively to hydrophilic colloidal binders such as gelatin.

Because photothermographic and thermographic elements require thermal processing, they pose different considerations and present distinctly different problems in manufacture and use. In addition, the effects of additives (e.g., stabilizers, antifoggants, speed enhancers, sensitizers, super-sensitizers, etc.) which are intended to have a direct effect upon the imaging process can vary depending upon whether they have been incorporated in a photothermographic or thermographic element or incorporated in a photographic element.

Distinctions between photothermographic and photographic elements are described in *Imaging Processes and Materials* (Neblette's Eighth Edition); J. Sturge et al. Ed; Van Nostrand Reinhold: New York, 1989; Chapter 9 and in *Unconventional Imaging Processes*; E. Brinckman et al, Ed; The Focal Press: London and New York: 1978; pp. 74–75.

Light sensitive recording materials may suffer from a phenomenon known as halation which causes degradation in the quality of the recorded image. Such degradation may occur when a fraction of the imaging light which strikes the photosensitive layer is not absorbed but passes through to the film base on which the photosensitive layer is coated. A portion of the light reaching the base may be reflected back to strike the photosensitive layer from the underside. Light thus reflected may, in some cases, contribute significantly to the total exposure of the photo-sensitive layer. Any particulate matter in the photo-sensitive element may cause light passing through the element to be scattered. Scattered light which is reflected from the film base will, on its second passage through the photosensitive layer, cause exposure over an area adjacent to the point of intended exposure. It is this effect which causes at least one form of image degradation. Photothermographic materials are prone to this form of image degradation since the photosensitive layers contain light scattering particles. The effect of light scatter on image quality is well documented and is described, for example, in T. H. James "*The Theory of the Photographic Process*", 4th Edition, Chapter 20, Macmillan 1977.

It is common practice to incorporate a light absorbing layer within the photothermographic element. The purpose of this layer is to absorb light that has been scattered within the various coatings and which would otherwise lead to reduced image sharpness. To be effective, the absorption of this layer must be at the same wavelengths as the sensitivity of the photo-sensitive layer.

In the case of imaging materials coated on transparent base, a light absorbing layer is frequently coated on the reverse side of the base from the photo-sensitive layer. Such a coating, known as a backside coated "antihalation layer", effectively reduces reflection of any light which has passed through the photosensitive layer. A similar effect may be achieved by a light absorbing layer interposed between the photosensitive layer and the base. This construction, described as an "antihalation underlayer" is applicable to photosensitive coatings on transparent or non-transparent bases. A light absorbing substance may be incorporated into the photosensitive layer itself to absorb scattered light. Substances used for this purpose are known as "acutance dyes". It is also possible to improve image quality by coating a light absorbing layer above the photosensitive layer of a photographic element. Coatings of this kind, described in U.S. Pat. Nos. 4,581,323 and 4,312,941, prevent multiple reflections of scattered light between the internal surfaces of a photographic element.

European Patent Application 0 377 961 and U.S. Pat. No. 4,581,325 describe infrared antihalation systems for photographic and photothermographic elements incorporating polymethine and holopolar dyes respectively. Although these dyes have good infrared absorbance, they have visible absorbance that is too high for use in subsequent exposures or viewing.

Antihalation systems that would satisfy a desired requirement of an IR/visible absorbance ratio of 30 to 1 would include the thermal-dye-bleach construction described in European Patent Application 0 403 157, and in U.S. patent application Ser. No. 08/072,153 (filed Nov. 23, 1993).

In addition to proper antihalation, a critical step in attaining proper sensitometric properties is the addition of photosensitive silver halide. It is well known in the art that the addition of silver halide grains to a photothermographic formulation can be implemented in a number of ways but basically the silver halide is either made "ex situ" and added to the organic silver salt or made "in situ" by adding a halide salt to the organic silver salt. The addition of silver halide grains to photothermographic materials is described in *Research Disclosure*, June 1978, Item No. 17029. It is also claimed in the art that when silver halide is made ex situ one has the possibility of controlling the composition and size of the grains much more precisely so that one can impart more specific properties to the photothermographic element and can do so much more consistently than with the in situ technique.

Other performance characteristics influenced by the silver halide component that are desired for achieving a high quality photothermographic material for medical and graphic arts applications are: increased development efficiency, increased photo-speed, increased maximum density (Dmax) and lower minimum density (Dmin), and lower haze. U.S. Pat. No. 4,435,499 claims that these characteristics are not well addressed by conventionally prepared cubic grain silver halide gelatino photographic emulsions used in ex situ formulations. In fact, they claim advantages for tabular grains that give increased speed while maintaining a high surface area so that silver efficiency remains high. However, it is well known that tabular grains give relatively broad size distributions which usually results in photosensitive materials of lower contrast than monomodal distributions.

While U.S. Pat. No. 4,435,499 demonstrates increased speed and increased development efficiency, it does not show that increased Dmax is attained or that Dmin and haze remain lower than if very fine conventional cubic grains are used. In fact, it is known that larger grains tend to give high levels of haze.

Infrared supersensitization of photographic and photothermographic materials to attain increased sensitivity is described in detail in U.S. patent application Ser. No. 07/846,919 filed Apr. 13, 1992.

Many different additives and modifications are made in photothermographic elements to optimize the image quality of the medium. It is normally desirable, for example, to make the distribution of image forming ingredients as uniform as possible throughout the emulsion layer(s) and to make the layers uniform in thickness and as smooth as possible.

When a high quality photothermographic medium is exposed by coherent radiation (e.g., laser imaging system) at a uniform exposure level across the entire surface of the sheet, a remarkably woodgrain-like appearance is produced across the entire surface. This adverse phenomenon (termed "woodgrain") is a spurious pattern produced in the medium upon exposure to coherent radiation and bears a remarkable resemblence to the pattern of grains in wood, hence the name. These patterns tend to be neither symmetrical nor repetitive, and like the grain in polished wood, appear as variations in optical density (lightness and darkness) on the image surface. Such spurious image patterns are of course undesirable in an system where the quality of the image is critical.

It was found by the Inventors, however, that the better the coating quality and general uniformity of photothermographic elements addressed by coherent radiation, the more prominant became the "woodgrain" patterns. Additionally, the more uniform the optical density of the developed image upon floodlight or uniform incandescent light exposure the more serious seemed to be the woodgrain pattern produced in the same medium upon exposure to coherent radiation.

This type of patterning presently has been found to be unique to photothermographic imaging systems, and even multiple scanning with a beam of coherent radiation (as done on commercial equipment for wet processed silver halide media and as disclosed in U.S. Ser. No. 08/198,970 filed Feb. 18, 1994 for photothermographic elements) has shown minimum improvement with respect to this particular type of patterning in the final image.

SUMMARY OF THE INVENTION

The present invention describes elements which further enable the attainment of a high quality photo-thermographic imaging system, especially those spectrally sensitized to the red or infrared, with excellent image quality, and particularly with uniform optical density characteristics and reduced levels or absence of woodgrain patterns. A further aspect is the possibility of low absorbance at 380 nm to facilitate graphic arts applications such as contact printing.

According to the present invention there is provided a spectrally sensitized photothermographic silver halide element comprising a support layer having on at least one surface thereof a photothermographic composition which displays uniform image density across its surface when exposed to floodlight or uniform incandescent light exposure at radiation wavelengths to which the element is sensitive, said element comprising at least two layers, including a top layer and a photo-thermographic emulsion layer, said photothermographic emulsion layer comprising a binder, a light insensitive silver source, a reducing agent for silver ion and infrared radiation sensitive silver halide grains, wherein the coherent radiation is rendered more diffuse in its passage through the element than when it strikes the top layer. This may be accomplished at least in part by 1) the top layer of the element having haze induced therein of 0.05 to 30% by surface modification of that layer, 2) there being a random refractive pattern on the top layer, 3) haze being induced in the silver halide containing layer, 4) the reflective characteristics of a surface of the support layer facing the photothermographic composition have been altered to reduce reflection of coherent radiation into said composition, and/or 5) having a radiation absorbing material contained within the photothermographic element to decrease light reflected off of the support.

When the above element is provided with the described proper physical modifications to alter certain characteristics in the imaging radiation as it passes into and/or through the photosensitive layers, uniform optical density with reduced woodgrain effects can be produced. In other words, the mechanisms used to reduce woodgrain include: diffusing the coherent radiation at the surface of the element, randomly distorting the refraction of coherent radiation at the surface of the element, absorbing radiation within the element, and/or altering the reflection characteristics of radiation from the support carrying the photo-sensitive photothermographic layer(s).

The present invention also provides a process for the exposure of an ultraviolet radiation sensitive imageable medium comprising the steps of:

a) exposing the photothermographic element to coherent radiation to which said silver halide grains are sensitive to generate a latent image, b) heating said element after exposure to develop said latent image to a visible image which is free of any visually observable woodgrain pattern.

c) positioning the element with a visible image thereon between an ultraviolet radiation energy source and a ultraviolet radiation photosensitive imageable medium, and d) then exposing said imageable medium to ultraviolet radiation through said visible image, absorbing ultraviolet radiation in the areas where there is a visible image and transmitting ultraviolet radiation where there is no visible image.

The present invention additionally provides a spectrally sensitized photothermographic silver halide element comprising a support layer having on at least one surface thereof a photothermographic emulsion layer which displays uniform image density across its surface when exposed to floodlight or uniform incandescent light exposure at a wavelength of radiation to which the composition is sensitive, and said element displaying less than 0.05 variation in average optical density between adjacent areas of 1 $mm^2$ when said element is uniformly exposed over its entire surface to coherent radiation to which said element is spectrally sensitive, said element including a top layer and said photothermographic emulsion layer comprising a binder, a light insensitive silver source, a reducing agent for silver ion, and radiation sensitive silver halide grains.

The infrared sensitive silver halide grains may be formed in situ or be pre-formed, but they are preferably pre-formed.

It is preferred that the silver halide grains have a number average grain size of less than 0.10 $\mu$m and an antihalation or acutance dye which has an infrared peak absorbance (before processing) to visible absorbance (before and/or after processing) ratio of greater than or equal to 30 to 1.

A further improvement is the incorporation of supersensitizers to enhance the infrared sensitivity of the article.

Combining these fine grains with the super-sensitizers described provides a high speed, high Dmax, high efficiency, low Dmin, and low haze element which is useful as a coherent radiation (e.g., laser) exposed film for both graphic arts and diagnostic imaging applications.

The reducing agent for the reducible source of silver may be a compound that can be oxidized directly or indirectly to form or release a dye.

When the photothermographic element used in this invention is heat developed, preferably at a temperature of from about 80° C. to about 250° C. (176° F. to 482° F.) for a duration of from about 1 second to about 2 minutes, in a substantially water-free condition after, or simultaneously with, imagewise exposure, an image is obtained either in exposed areas or in unexposed areas with exposed photosensitive silver halide.

Heating in a substantialy water-free condition as used herein, means heating at a temperature of 80° to 250° C. The term "substantially water-free condition" means that the reaction system is approximately in equilibrium with water in the air, and water for inducing or promoting the reaction is not particularly or positively supplied from the exterior to the element. Such a condition is described in T. H. James *The Theory of the Photographic Process*, Fourth Edition, page 374.

As used herein, the term "emulsion layer" means a layer of a photothermographic element that contains photosensitive silver salt (e.g., silver halide) and light-insensitive silver source material.

As used herein the term "photothermographic element" means a construction comprising at least one photothermographic emulsion layer and any supports, topcoat layers, image receiving layers, blocking layers, antihalation layers, subbing or priming layers, etc.

For the purposes of this invention the infrared region of the spectrum is defined as 750-1400 nm, the visible region of the spectrum is defined as 400–750 nm, and the red region of the spectrum is defined as 640–750 nm. Preferably the red region of the spectrum is 650–700 nm.

DETAILED DESCRIPTION OF THE INVENTION

To date, photothermographic systems have not been useful for medical diagnostic or graphic arts laser recording purposes because of slow speed, low Dmax, poor contrast and insufficient sharpness at high Dmax. Copending U.S. patent applications Ser. Nos. 08/072,153 (filed Nov. 23, 1993) and Ser. No. 08/239,984 (filed May 9, 1994) describe most of the characteristics and attributes of a photothermographic element having, for example, an antihalation system, silver halide grains having an average particle size of less than 0.10 $\mu$m, and infrared supersensitization leading to an infrared photothermographic article reaching the requirements for medical or graphic arts laser recording applications.

One of the significant causes of the woodgrain problem is the high quality and consistency and uniformity of the photosensitive coating(s) and layer(s). In the practice of the present invention, uniform coatings are those photothermographic layer(s) on a transparent support which, when uniformly imaged with an incandescent light exposure at the wavelength of maximum sensitivity of the photothermographic layer(s) and uniformly thermally developed provides an image which does not vary significantly in optical density from one exposed area to another by more than 5% in optical density units at a greyout optical density of 1.8 with uniform backlighting of the imaged medium. This concept of uniformity in the coating is important to appreciate. Without the uniformity in coating quality, the image capability of the material is sufficient for medical radiographic purposes, as well as other high image quality imaging formats. However, it is attaining the modern limits of coating quality which in fact creates the very problem of woodgraining.

The most readily observable embodiment of coating quality which can be visually observed is in an image on a film base which is uniformly flooded with light from an incandescent source and observed through backlighting with white light as used on medical radiographic imaging screens. The photothermographic element is then uniformly heated (this can be done with the thermal developing system described in U.S. patent application Ser. No. 08/239,709, filed on May 9, 1994, and U.S. patent application Ser. No. 08/289,284. The intensity is controlled according to the sensitometry of the media to provide a "gray out," an optical density of between 1.0 and 2.0, preferably between 1.5 and 1.9, and most preferably about 1.8 uniformly over the surface. A uniform optical density is attained when the image observed through the backlit developed medium on a transparent base displays visually observable optical density variations of less than 0.1, preferably less than 0.075, more preferably less than 0.05 and still more preferably less than 0.04, and most preferably less than 0.03. It is possible to actually measure these values, but visual observation is the best critical evaluation of consistency. The degree in variation in optical densities throughout the imaged article when backlit is reasonably related to the uniformity of the coating in both thickness and composition. It is to be noted that the highest grades of commercial photothermographic film previously sold displays very high and very random variations in image density when so imaged and developed.

Although Applicants can only hypothesize as to the exact cause of the woodgrain phenomenon it appears to be caused by minute variations in the thickness of the photothermographic imaging layer(s). These presumed minute variations allow the coherent imaging radiation to form optical interference patterns which alter the effective imaging intensity of the radiation (higher or lower) in a random pattern. In essence, the minor variations in thickness (which appear to be within the order of 10–200 nm variations and display some inherent periodicity) in the total thickness of 10–40 $\mu$m thick photosensitive layer(s) appear to cause varying amounts of interference within the photosensitive layer(s).

Amongst the features of this phenomenon are the facts that the phenomenon is non-existent in incandescent exposure of the same medium at the same wavelength as that of the coherent radiation exposure, and that the effect becomes more pronounced as the uniformity of the photosensitive layer coatings is improved. Fringe suppression in laser exposed photographic elements was taught in U.S. Pat. No. 4,711,838 (Grzeskowiak and Philip). The phenomenon addressed by this patent is different from the woodgrain pattern in photothermographic elements. The woodgrain problem is unique to photothermographic elements because of the weak absorption and minimal scattering in photothermographic elements.

Four distinct modifications of the photothermographic elements in the practice of this invention have been found to be effective to reduce the woodgrain effect in the developed image: (1) Increasing haze of the top coat (the uppermost layer) and/or emulsion layer (top coat surface roughening, refractive index inhomogeneity in top coat or silver emulsion), (2) Roughening of the interface between the photosensitive layer and the support, (3) Reducing or dispersing the reflection at the emulsion-support interface, and (4) Incorporating an accutance dye in the emulsion layer.

The invention may be considered from a number of different scientific perspectives. One of those perspectives is as a spectrally sensitized photothermographic silver halide element comprising a support layer having on at least one surface thereof a photothermographic emulsion layer which displays uniform image density across its surface when exposed to floodlight or uniform incandescent light exposure at a wavelength of radiation to which the composition is sensitive, and said element displaying less than 0.05 variation in average optical density amongst any three linearly consecutive areas defined by squares (i.e., three squares in a row forming a rectangle of dimensions 1 [square side]×3 [square sides]) of from 0.5 $mm^2$ to 5 $cm^2$ when said element is uniformly exposed over its entire surface to coherent radiation to which said element is spectrally sensitive, said photothermographic element including a top layer and said photothermographic emulsion layer comprising a binder, a light insensitive silver source, a reducing agent for silver ion, and radiation sensitive silver halide grains. The three linearly consecutive areas are reasonably selected as squares of 1 $mm^2$. The element of the invention may be further described by another perspective in which it is seen that the top layer displays a first spatial frequency of variations in a first property which alters light refraction and/or light reflection, said first property being selected from the group consisting of surface planarity (smoothness) and (uniformity of) thickness, and said element having at least one second property which alters light refraction and/or light reflection provided by at least one of said photothermographic emulsion layer, said top layer, and said support layer, said second property being a second spatial frequency of variations which is a frequency which is significantly higher (e.g., at least 25% higher), preferably at least two times higher (more preferably at least 5 times higher and still more preferably at least 10 times higher, depending upon the actual numerical value of said firsty spatial frequency) than said first spatial frequency. This second property can be provided at least in part by at least one feature selected from the group consisting of a) the inclusion of particulates other than silver salts of organic acids in the photothermographic emulsion layer or the top coat, b) adding acutance dyes in said photothermographic emulsion layer, c) increasing haze in said photothermographic element (either in the top coat, the photothermographic emulsion layer, and/or in a primer layer), and d) providing a primer layer on said support layer which has an index of refraction intermediate the index of refraction of said support layer and said photothermographic emulsion layer. The reflective properties of the base may be altered by abrasion or other disfiguring of that surface.

The optical qualities of the surface of the photothermographic element may be modified by increasing the haze of the surface layer (rendering radiation which passes through the surface more diffuse within the photosensitive layers than before striking the medium).

The haze of the surface layer may be increased by adding particulates into the top layer (e.g., silica, polymeric beads, etc.), preferably in a size range of 1–12 $\mu$m in average size, more preferably 1.5 to 10 $\mu$m in average size, and most preferably 2–9 $\mu$m in average size, particularly with fewer than 25% of the total number of particulates being outside a range of ±15% of the average size of the particles). The particles may constitute as little as 0.5% of the surface area to have an observable effect on woodgrain reduction, and may be present in amounts up to 25% of the surface area. The particulates may contribute as much as 20% to haze (or even more) while reducing woodgrain, but for other image quality considerations it is more usual to have the particles increase haze by 0.1 to 15%, more preferably by 0.5 to 8%, and most preferably by 1 to 6% in reducing woodgrain. The imposition of these levels of haze in the surface layer reduces the woodgrain effect.

When woodgrain is reduced by the incorporation of a plurality of optically transparent polymeric beads, into at least one of the layers of the photothermographic element the composition of the polymeric beads is chosen such that substantially all of the visible wavelengths (400 nm to 700 nm) are transmitted through the material to provide optical transparency. Non-limiting examples of polymeric beads that have excellent optical transparency include polymethyl methacrylate and polystyrene methacrylate beads, described in U.S. Pat. No. 2,701,245; and beads comprising diol dimethacrylate homopolymers or copolymers of these diol dimethacrylates with long chain fatty alcohol esters of methacrylic acid and/or ethylenically unsaturated comonomers, such as stearyl methacrylate/hexanediol diacrylate crosslinked beads, as described in U.S. Pat. No. 5,238,736 and U.S. Pat. No. 5,310,595.

Even though the polymeric beads are optically transparent, haze can be introduced into the photothermographic elements depending upon the shape, surface characteristics, concentration, size, and size distribution of the beads. The smoothness of the bead surface and shape of the bead are chosen such that the amount of reflected visible wavelengths (400 nm to 700 nm) of light is kept to a minimum. The shape of the beads is preferably spherical, oblong, ovoid, or elliptical. The particle diameter is preferably in a size range of 1–12 μm in average size; more preferably, 1.5 to 10 μm in average size; and most preferably, 2–9 μm in average size, particularly with fewer than 25% of the total number of beads being outside a range of ±15% of the average size of the beads. In some elements, it is advantageous to add two distinct sets of beads with different average sizes. This allows the flexibility to balance haze with slip or separation characteristics. The beads may be present on the surface from about 50 to 500 beads/mm$^2$; more preferably, 75 to 400 beads/mm$^2$; and most preferably, 100 to 300 beads/mm$^2$. The increase in percent haze due to the introduction of the beads into the element is preferably at least 0.5%, and no more than 15%; more preferably at least 1% and no more than 8%; and most preferably at least 1% and no more than 6%.

The haze may also be affected by microstructuring of the surface layer (e.g., as by microembossing or texturizing of the surface). This can be done by microreplication techniques or calendaring or embosser rolls with appropriate patterns to generate the desired level of haze (e.g., greater than 0.1% up to 30%, and the preferred ranges described above). These surface modification techniques, or otherwise inducing random variations into the smoothness of the surface of the topcoat, will reduce woodgrain effects. The term 'random variations' must be considered within the context of the practice of this invention, as even the best applied coatings have an uncontrollable and inexact variation in thickness and surface characteristics. In fact, it is the high quality and reduced degree of these variations (keeping the existing variations within a tight tolerance) which is one of the reasons why the woodgrain pattern exists. The small thickness variations are large enough to create the interference patterns encountered with coherent light exposure. The woodgrain pattern caused by these variations have visible features on the order of 0.5 mm to 5 cm in size. These variations, depending on the particular quality of the coating, may be concentrated in ranges of, for example, 0.5 to 5 mm and from 1.0 mm to 5 cm. The random pattern or random variation according to the practice of the present invention causes the density variations due to interference to occur with a spatial frequency high enough so as to be invisible with the naked eye. Effectively this has been estimated as creating random variations in the surface layer of a uniform density photothermographic element wherein the variation have dimensions of greater than 20 nm, more preferably greater than 30 nm, and still more preferably greater than 40 nm, and most preferably greater than 50, 60, or even 70 nm. These micro variations in the surface should be random, not in a clear repeating pattern. It is estimated that these variations should cover at least 10%, preferably at least 15%, of the surface area of the elevated variation from planarity and should comprise at least 20% of the surface area of the top layer of the photothermographic element to provide visible benefits in woodgrain reduction.

A model has been developed which seems to indicate a clear correlation between the standard deviation of the thickness of the topcoat layer and the peak-to-peak woodgrain density variation. This model is theoretic in nature, but corresponds to the variation in optical woodgrain effects with variations in the thickness of the topcoat. Where the topcoat is nearly perfect, with standard deviations in thickness less than 10 nm, the peak-to-peak optical density variation in the woodgrain pattern appears to be about 0.04 optical density units. At 20 nm standard deviation, the peak-to-peak density variation is predicted at about 0.025, and at 60 nm, this value should drop to less than 0.015. The peak-to-peak density-variation is also predicted to drop to less than 0.01 for standard deviations in top coat above about 70 nm. These estimates have been roughly confirmed by experimental results in modifications of the surface characteristics and thickness, at least to the degree that increases in such variations tend to diminish the woodgrain effect.

The addition of particulates in the photosensitive layer (the silver halide containing layer) may also cause an apparently distinct effect which is a benefit against the woodgrain effect. The particles in the silver halide layer may increase haze and, as with the top coat layer containing particulates, disperse the coherent radiation a sufficient degree to reduce the woodgrain effect. When the particles are generated in the silver halide layer by blending two different resins which are not stable in a single phase (using polyvinyl butyral, for example, as the primary binder for the photothermographic layer(s) containing the silver halide, such binders as polyester resins (e.g., PE 220 polyester), polyvinyl acetate, etc., separate out of the blend as particulates dispersed within the polyvinyl butyral phase. These in situ generated particulates have been noted as tending to deposit or contact the substrate (or primer layer on the substrate) when the silver halide layer containing these materials is deposited on the substrate. These particulates tend to not affect the smoothness of the surface of the top coat layer as they tend to be significantly smaller in size than the thickness of the silver halide containing layer and remain immersed or buried within that layer. These particulates may have an average size which appears to be on the order of 1/10 to 2/3 the dimensions of the thickness of the silver halide containing layer.

The presence of these particulates has also been noted as improving the adhesion of the silver halide containing layer to the substrate.

The particulates which alter the refractive properties of the surface layers, on the other hand, are provided in the photosensitive layers in such a manner that they tend to protrude from the surface of the top layer to cause the radiation diffusive effects. The dimension(s) of the thickness of photosensitive layer(s) in a photothermographic element according to the present invention tend to be on the order of 10–40 μm for a single trip photosensitive element and 0.5 to 6 μm for the topcoat and 10–40 μm for the silver trip layer in a two layer photothermographic system. In the two trip construction, which is the preferred embodiment of the present invention, the particulates are applied in the topcoat composition and should generally be within the ranges indicated above for the particles (e.g., between 1 and 12 μm in number average diameter).

Alteration of the refractive characteristics of the surface may be accomplished, for example, by including particulates within the photothermographic emulsion layer (in a single trip or two trip construction) which cause the surface of the topcoat (or the surface of the emulsion layer in a single trip coating) to bulge over the particles. These bulges induce variations in both the angle at which coherent imaging radiation strikes the surface of the photothermographic element and causes a variation in the distance which the radiation must travel to impact the support layer. These randomly imposed variations are enough to alter the pattern of light travel through the photosensitive medium (and the light reflected from the backside) to reduce or eliminate the woodgrain pattern. Again, these internally induced random variations preferably cover the dimensions noted above.

Modification of the internal reflection characteristics of the support which should be effected to reduce woodgrain patterns according to the present invention include alteration of the refractive index of the surface and altering the reflective pattern of the support. The refractive index of the support is changed by applying a coating thereto which is closer to the refractive index of the photothermographic layer(s) adjacent the support. This alteration reduces the amount of radiation reflected from the support and reduces the amounts of interference which can occur between radiation paths within the photosensitive element. The reflective pattern of the support may be altered by changes in the smoothness characteristics of the surface. Although it has been generally traditional to seek the smoothest surface possible for internal layers, it is effective in the practice of the present invention to roughen the surface of the support layer which faces the photothermographic emulsion(s) to reduce the woodgrain effect. Roughening may be performed on the base prior to coating it with the photothermographic layer(s) by any available technique, including but not limited to abrasion, chemical etching, sputter etching, ablation (e.g., by laser, flash lamp, ion diode, coaxial plasma accelerator, ion accelerator, etc.), non-ablative high energy treatments such as quasi-amorphization (e.g., see U.S. Pat. Nos. 4,879,176 and 4,822,451), and the like. It is desirable to apply these processes to the support to reduce reflection at the wavelength of the imaging coherent radiation by at least 0.5% up to 50% or even 100% (being totally transparent or totally absorptive of the exposing radiation, e.g., infrared radiation, while being transmissive of visible radiation), more reasonably between 2 and 25%. It has also been noted that certain applications of these high energy surface treatments do not ablate the surface yet improve woodgrain resistance. It has been suggested by the inventors that high energy, non-ablative treatment of the surface may be changing the refractive index of the surface without ablating material. This could be the result of crystalline morphologic changes in the surface (as in quasi-amorphization of semicrystalline or polyimide materials) which change in crystalline state is displayed at least in part by a change in the index of refraction.

Another technique to effectively roughen-the surface of the support is to apply a coating of optically roughening material prior to coating the layers of the photothermographic element.

Antihalation and Acutance Materials

Photothermographic elements according to the present invention can contain antihalation and acutance, U.S. Pat. Nos. 5,266,452, and 5,314,795. If desired, the dyes can be mordanted, for example, as described in U.S. Pat. No. 3,282,699.

Infrared antihalation systems that satisfy the requirement of an IR/visible absorbance ratio of 30 to 1 after processing are the thermal-dye-bleach constructions described in U.S. Pat. No. 5,314,795 and in U.S. patent application Ser. No. 08/072,153 (filed Nov. 23, 1993).

Another infrared antihalation system that satisfies the requirement-of an IR/visible absorbance ratio of 30 to 1 after processing would be the thermal-dye-bleach construction described in U.S. Pat. Nos. 5,135,842 and 5,266,452. For example, dyes, D-9 and D-10 of the above U.S. Patents, when used in the thermal-dye-bleach formulation do not have a 30 to 1 ratio of IR/visible absorbance before heat processing. Only after thermal bleaching does the system satisfy the 30 to 1 ratio.

An infrared antihalation system that satisfies the requirement of an IR/visible absorbance ratio of 30 to 1 before and after processing can be achieved with non-bleaching indolenine dyes.

Useful dyes were shown in U.S. patent application Ser. No. 07/846,919 to be a weak infrared sensitizer in photothermographic systems. However, the minimum amount of dye of those formulae for use for acutance purposes greatly exceeds the maximum amount of dye used for sensitizing purposes. For example, the quantity of sensitizing dye used in the photothermographic emulsion disclosed in U.S. patent application Ser. No. 07/846,919 was 3.1 mg/meter$^2$ whereas for acutance purposes in accordance with the invention the dyes would generally be used at a higher level.

Although many of the dyes described above are heptamethine dyes, it is also anticipated that similar nonamethine dyes would be suitable for use-as acutance and antihalation dyes.

The dyes are generally added to the photothermographic element in a sufficient amount to provide a transmission optical density of greater than 0.1 at $\lambda$max of the dye. Generally, the coating weight of the dye which will provide the desired effect is from 5 to 200 mg/meter$^2$, more preferably as 10 to 150 mg/meter$^2$. For purposes of good viewing of the imaged and developed film, or for exposing through the imaged-developed film it is desirable to for the dye to have a visible absorbance less of $\leqq 0.01$ or to be bleached to a material having a visible absorbance of $\leqq 0.01$).

The dyes may be incorporated into photothermographic elements as acutance dyes according to conventional techniques. The dyes may also be incorporated into antihalation layers according to techniques of the prior art as an antihalation backing layer, an antihalation underlayer or as an overcoat.

The Photosensitive Silver Halide

As noted above, the present invention includes a photosensitive silver halide in the photothermographic element. The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver.

The silver halide may be in any form which is photosensitive including, but not limited to cubic, octahedral, rhombic dodecahedral, orthrohombic, tetrahedral, other polyhedral habits, etc., and may have epitaxial growth of crystals thereon. Tabular grains are not preferred and are in fact least preferred crystal habits to be used in the photothermographic elements of the present invention. Narrow grain size distributions of truly tabular grains (e.g., with aspect ratios of 5:1 and greater) can not be readily provided by existing techniques with the preferred grain sizes of less than an average diamater size of 0.10 $\mu$m. There are grains refered to in the art as "tabular,""laminar," or "sigma" grains which may have aspect ratios of less than 5:1, such as disclosed in U.S. Pat. No. 4,806,461 which shows "tabular" twinned plane grains called laminar grains with aspect ratios equal to or greater than 2:1 with grain thickness of less than 0.5 $\mu$m and grain diameter averages of less than 0.3, but it is not clear that such grains are within the consideration of the ordinarily skilled artisan as laminar or tabular grains as much as they are merely definitions broadening the coverage of the terms without the conceptual benefits of the original disclosures of tabular grains in providing higher capture surface areas to volume ratios for the silver halide grains (e.g., higher projected areas per coating weight of grains as in U.S. Pat. Nos. 4,425,425 and 4,425,426).

The silver halide grains may have a uniform ratio of halide throughout; they may have a graded halide content, with a continuously varying ratio of, for example, silver bromide and silver iodide; or they may be of the core-shell-type, having a discrete core of one halide ratio, and a discrete shell of another halide ratio. Core-shell type silver halide grains useful in photothermographic elements and methods of preparing these materials are described in allowed copending U.S. patent application Ser. No. 08/199,114 (filed Feb. 22, 1994). A core-shell silver halide grain having an iridium doped core is particularly preferred. Iridium doped core-shell grains of this type are described in copending U.S. patent application Ser. No. 08/239,984 (filed May 9, 1994).

The silver halide may be prepared ex situ, (i.e., be pre-formed) and mixed with the organic-silver salt in a binder prior to use to prepare a coating solution. The silver halide may be pre-formed by any means, e.g., in accordance with U.S. Pat. No. 3,839,049. For example, it is effective to blend the silver halide and organic silver salt using-a homogenizer for a long period of time. Materials of this type are often referred to as "pre-formed emulsions." Methods of preparing these silver halide and organic silver salts and manners of blending them are described in *Research Disclosure*, June 1978, item 17029; U.S. Pat. Nos. 3,700,458 and 4,076,539; and Japanese patent application Nos. 13224/74, 42529/76, and 17216/75.

It is desirable in the practice of this invention to use pre-formed silver halide grains of less than 0.10 $\mu$m in an infrared sensitized, photothermographic material. Preferably the number average particle size of the grains is between 0.01 and 0.08 $\mu$m; more preferably, between 0.03 and 0.07 $\mu$m; and most preferably, between 0.04 and 0.06 $\mu$m. It is also prefered to use iridium doped silver halide grains and iridium doped core-shell silver halide grains as disclosed in copending U.S. patent application Ser. Nos. 08/072,153, and 08/239,984 described above.

Pre-formed silver halide emulsions when used in the material of this invention can be unwashed or washed to remove soluble salts. In the latter case the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341.

It is also effective to use an in situ process, i.e., a process in which a halogen-containing compound is added to an organic silver salt to partially convert the silver of the organic silver salt to silver halide.

The light sensitive silver halide used in the present invention can be employed in a range of about 0.005 mole to about 0.5 mole; preferably, from about 0.01 mole to about 0.15 mole per mole; and more preferably, from 0.03 mole to 0.12 mole per mole of non-photosensitive reducible silver salt.

The silver halide used in the present invention may be chemically and spectrally sensitized in a manner similar to that used to sensitize conventional wet process silver halide or state-of-the-art heat-developable photographic materials. For example, it may be chemically sensitized with a chemical sensitizing agent, such as a compound containing sulfur, selenium, tellurium, etc., or a compound containing gold, platinum, palladium, ruthenium, rhodium, iridium, etc., a reducing agent such as a tin halide, etc., or a combination thereof. The details of these procedures are described in T. H. James *The Theory of the Photographic Process*, Fourth Edition, Chapter 5, pages 149 to 169. Suitable chemical sensitization procedures are also described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

Addition of sensitizing dyes to the photosensitive silver halides serves to provide them with high sensitivity to visible and infrared light by spectral sensitization. Thus, the photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. of these dyes, cyanine dyes, merocyanine dyes, and complex merocyanine dyes are particularly useful.

An appropriate amount of sensitizing dye added is generally about $10^{-10}$ to $10^{-1}$ mole; and preferably, about $10^{-8}$ to $10^{-3}$ moles per mole of silver halide.

Supersensitizers

To get the speed of the photothermographic elements up to maximum levels and further enhance infrared sensitivity, it is often desirable to use supersensitizers. Any supersensitizer could be used which increases the infrared sensitivity, but the preferred supersensitizers are described in copending U.S. patent application Ser. No. 07/846,919 and include heteroaromatic mercapto compounds (I) or heteroaromatic disulfide compounds (II)

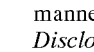

Ar—SM (I)

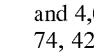

Ar—S—S—Ar (II)

wherein M represents a hydrogen atom or an alkali metal atom.

In supersensitizers (I) and (II), Ar represents an aromatic ring or fused aromatic ring containing one or more of nitrogen, sulfur, oxygen, selenium or tellurium atoms. Preferably, the heteroaromatic ring is benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. However, other heteroaromatic rings are envisioned under the breadth of this invention.

The heteroaromatic ring may also carry substituents with examples of preferred substituents being selected from the class consisting of halogen (e.g., Br and Cl), hydroxy, amino, carboxy, alkyl (e.g. of 1 or more carbon atoms, preferably 1 to 4 carbon atoms) and alkoxy (e.g. of 1 or more carbon atoms, preferably of 1 to 4 carbon atoms.

The preferred supersensitizers are 2-mercaptobenzimidazole, 2-mercapto-5-methylbenzimidazole and 2-mercaptobenzothiazole.

The supersensitizers are used in general amount of at least 0.001 moles/mole of silver in the emulsion layer. Usually the range is between 0.001 and 1.0 moles of the compound per-mole of silver and preferably between 0.01 and 0.3 moles of compound per mole of silver.

The Non-Photosensitive Reducible Silver Source Material

The non-photosensitive reducible silver source that can be used in the present invention can be any material that contains a source of reducible silver ions. Preferably, it is a silver salt which is comparatively stable to light and forms a silver image when heated to 80° C. or higher in the presence of an exposed photocatalyst (such as silver halide) and a reducing agent.

Silver salts of organic acids, particularly silver salts of long chain fatty carboxylic acids, are preferred. The chains typically contain 10 to 30, preferably 15 to 28, carbon atoms. Suitable organic silver salts include silver salts of organic compounds having a carboxyl group. Examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate, silver camphorate, and mixtures thereof, etc. Silver salts that can be substituted with a halogen atom or a hydroxyl group also can be effectively used. Preferred examples of the silver salts of aromatic carboxylic acid and other carboxyl group-containing compounds include: silver benzoate, a silver-substituted benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc.; silver gallate; silver tannate; silver phthalate; silver terephthalate; silver salicylate; silver phenylacetate; silver pyromellilate; a silver salt of 3-carboxymethyl-4-methyl-4-thiazoline-2-thione or the like as described in U.S. Pat. No. 3,785,830; and a silver salt of an aliphatic carboxylic acid containing a thioether group as described in U.S. Pat. No. 3,330,663.

Silver salts of compounds containing mercapto or thione groups and derivatives thereof can also be used. Preferred examples of these compounds include: a silver salt of 3-mercapto-4-phenyl-1,2,4-triazole; a silver salt of 2-mercaptobenzimidazole; a silver salt of 2-mercapto-5-aminothiadiazole; a silver salt of 2-(2-ethylglycolamido) benzothiazole; a silver salt of thioglycolic acid, such as a silver salt of a S-alkylthioglycolic acid (wherein the alkyl group has from 12 to 22 carbon atoms); a silver salt of a dithiocarboxylic acid such as a silver salt of dithioacetic acid; a silver salt of thioamide; a silver salt of 5-carboxylic-1-methyl-2-phenyl-4-thiopyridine; a silver salt of mercaptotriazine; a silver salt of 2-mercaptobenzoxazole; a silver salt as described in U.S. Pat. No. 4,123,274, for example, a silver salt of a 1,2,4-mercaptothiazole derivative, such as a silver salt of 3-amino-5-benzylthio-1,2,4-thiazole; and a silver salt of a thione compound, such as a silver salt of 3-(2-carboxyethyl)-4-methyl-4-thiazoline-2-thione as disclosed in U.S. Pat. No. 3,201,678. Silver salts of acetylenes can also be used. Silver acetylides are described in U.S. Pat. Nos. 4,761,361 and 4,775,613.

Furthermore, a silver salt of a compound containing an imino group can be used. Preferred examples of these compounds include: silver salts of benzotriazole and substituted derivatives thereof, for example silver methylbenzotriazole and silver 5-chlorobenzotriazole, etc.; silver salts of 1,2,4-triazoles or 1-H-tetrazoles as described in U.S. Pat. No. 4,220,709; and silver salts of imidazoles and imidazole derivatives.

It is also found convenient to use silver half soaps. A preferred example of a silver half soap is an equimolar blend of silver behenate and behenic acid, which analyzes for about 14.5% silver and which is prepared by precipitation from an aqueous solution of the sodium salt of commercial behenic acid.

Transparent sheet materials made on transparent film backing require a transparent coating. For this purpose a silver behenate full soap, containing not more than about 4 or 5 percent of free behenic acid and analyzing about 25.2 percent silver, can be used.

The method used for making silver soap dispersions is well known in the art and is disclosed in *Research Disclosure*, April 1983, item 22812, *Research Disclosure*, October 1983, item 23419, and U.S. Pat. No. 3,985,565.

The silver halide and the non-photosensitive reducible silver source material that form a starting point of development should be in catalytic proximity, i.e., reactive association. By "catalytic proximity" or "reactive association" is meant that they should be in the same layer, in adjacent layers, or in layers separated from each other by an intermediate layer having a thickness of less than 1 micrometer (1 $\mu$m). It is preferred that the silver halide and the non-photosensitive reducible silver source material be present in the same layer.

Photothermographic emulsions containing pre-formed silver halide in accordance with this invention can be sensitized with chemical sensitizers, or with spectral sensitizers as described above.

The source of reducible silver material generally constitutes about 5 to about 70 percent by weight of the emulsion layer. It is preferably present at a level of about 10 to about 50 percent by weight of the emulsion layer.

The Reducing Agent for the Non-Photosensitive Reducible Silver Source

When used in blaack-and-white photothermographic elements, the reducing agent for the organic silver salt may be any material, preferably organic material, that can reduce silver ion to metallic silver. Conventional photographic developers such as phenidone, hydroquinones, and catechol are useful, but hindered bisphenol reducing agents are preferred.

When the photothermographic element used in this invention containing a reducing agent for the non-photosensitive reducible silver source is heat developed, preferably at a temperature of from about 80° C. to about 250° C. (176° F. to 482° F.) for a duration of from about 1 second to about 2 minutes, in a substantially water-free condition after, or simultaneously with, imagewise exposure, a black-and-white silver image is obtained either in exposed areas or in unexposed areas with exposed photosensitive silver halide.

A wide range of reducing agents has been disclosed in dry silver systems including amidoximes, such as phenylamidoxime, 2-thienylamidoxime and p-phenoxyphenylamidoxime; azines, such as 4-hydroxy-3,5-dimethoxybenzaldehydeazine; a combination of aliphatic carboxylic acid aryl hydrazides and ascorbic acid, such as 2,2'-bis(hydroxymethyl)propionyl-β-phenylhydrazide in combination with ascorbic acid; a combination of polyhydroxybenzene and hydroxylamine; a reductone and/or a hydrazine, such as a combination of hydroquinone and bis(ethoxyethyl)hydroxylamine, piperidinohexose reductone, or formyl-4-methylphenylhydrazine; hydroxamic acids, such as phenylhydroxamic acid, p-hydroxyphenylhydroxamic acid, and o-alaninehydroxamic acid; a combination of azines and sulfonamidophenols, such as phenothiazine with p-benzenesulfonamidophenol or 2,6-dichloro-4-benzenesulfonamidophenol; α-cyanophenylacetic acid derivatives, such as ethyl α-cyano-2-methylphenylacetate, ethyl α-cyano-phenylacetate; bis-o-naphthols, such as by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, such as 2,4-dihydroxybenzophenone or 2,4-dihydroxyacetophenone; 5-pyrazolones such as 3-methyl-1-phenyl-5-pyrazolone; reductones, such as dimethylaminohexose reductone, anhydrodihydroaminohexose reductone, and anhydrodihydro-piperidone-hexose reductone; sulfonamidophemol reducing agents, such as 2,6-dichloro-4-benzenesulfonamidophenol and p-benzenesulfonamidophenol; indane-1,3-diones, such as 2-phenylindane-1,3-dione; chromans, such as 2,2-dimethyl-7-t-butyl-6-hydroxychroman; 1,4-dihydropyridines, such as 2,6-dimethoxy-3,5-dicarbethoxy-1,4-dihydropyridine;

bisphenols, such as bis(2-hydroxy-3-t-butyl-5-methylphenyl)methane, 1,1-bis(2-hydroxy-3,5-dimethylphenyl)-3,5,5-trimethylhexane, 2,2-bis(4-hydroxy-3-methylphenyl)propane, 4,4-ethylidene-bis(2-t-butyl-6-methylphenol), and 2,2-bis(3,5-dimethyl-4-hydroxyphenyl) propane; ascorbic acid derivatives, such as 1-ascorbylpalmitate, ascorbylstearate; unsaturated aldehydes and ketones; certain 1,3-indanediones, and 3-pyrazolidones (phenidones).

The reducing agent should be present as 1 to 10% by weight of the imaging layer. In multilayer elements, if the reducing agent is added to a layer other than an emulsion layer, slightly higher proportions, of from about 2 to 15%, tend to be more desirable.

The Optional Dye-Forming or Dye-Releasing Material

As noted above, the reducing agent for the reducible source of silver may be a compound that can be oxidized directly or indirectly to form or release a dye.

When the photothermographic element used in this invention containing an optional dye-forming or dye-releasing material is heat developed, preferably at a temperature of from about 80° C. to about 250° C. (176° F. to 482° F.) for a duration of from about 1 second to about 2 minutes, in a substantially water-free condition after, or simultaneously with, imagewise exposure, a dye image is obtained simultaneously with the formation of a silver image either in exposed areas or in unexposed areas.

Leuco dyes are one class of dye-forming material that form a dye upon oxidation. Any leuco dye capable of being oxidized by silver ion to form a visible image can be used in the present invention. Leuco dyes that are both pH sensitive and oxidizable can also be used, but are not preferred. Leuco dyes that are sensitive only to changes in pH are not included within scope of dyes useful in this invention because they are not oxidizable to a colored form.

As used herein, a "leuco dye" or "blocked leuco dye" is the reduced form of a dye that is generally colorless or very lightly colored and is capable of forming a colored image upon oxidation of the leuco or blocked leuco dye to the dye form. Thus, the blocked leuco dyes (i.e., blocked dye-releasing compounds), absorb less strongly in the visible region of the electromagnetic spectrum than do the dyes. The resultant dye produces an image either directly on the sheet on which the dye is formed or, when used with a dye- or image-receiving layer, on the image-receiving layer upon diffusion through emulsion layers and interlayers.

Representative classes of leuco dyes that can used in the photothermographic elements of the present invention include, but are not limited to: chromogenic leuco dyes, such as indoaniline, indophenol, or azomethine leuco dyes; imidazole leuco dyes, such as 2-(3,5-di-t-butyl-4-hydroxyphenyl)-4,5-diphenylimidazole, as described in U.S. Pat. No. 3,985,565; dyes having an azine, diazine, oxazine, or thiazine nucleus such as those described in U.S. Pat. Nos. 4,563,415; 4,622,395; 4,710,570; and 4,782,010; and benzylidene leuco compounds as described in U.S. Pat. No. 4,923,792.

Another preferred class of leuco dyes useful in this invention are those derived from azomethine leuco dyes or indoaniline leuco dyes. These are often referred to herein as "chromogenic leuco dyes" because many of these dyes are useful in conventional, wet-processed photography. Chromogenic dyes are prepared by oxidative coupling of a p-phenylenediamine compound or a p-aminophenol compound with a photographic-type coupler. Reduction of the corresponding dye as described, for example, in U.S. Pat. No. 4,374,921 forms the chromogenic leuco dye. Leuco chromogenic dyes are also described in U.S. Pat. No. 4,594,307. Cyan leuco chromogenic dyes having short chain carbamoyl protecting groups are described in European Laid Open Patent Application No. 533,008. For a review of chromogenic leuco dyes, see K. Venkataraman, The *Chemistry of Synthetic Dyes*, Academic Press: New York, 1952; Vol. 4, Chapter VI.

Another class of leuco dyes useful in this invention are "aldazine" and "ketazine" leuco dyes. Dyes of this type are described in U.S. Pat. Nos. 4,587,211 and 4,795,697. Benzylidene leuco dyes are also useful in this invention. Dyes of this type are described in U.S. Pat. No. 4,923,792.

Yet another class of dye-releasing materials that form a diffusible dye upon oxidation are known as pre-formed-dye-release (PDR) or redox-dye-release (RDR) materials. In these materials, the reducing agent for the organic silver compound releases a mobile pre-formed dye upon oxidation. Examples of these materials are disclosed in Swain, U.S. Pat. No. 4,981,775.

Further, as other image-forming materials, materials where the mobility of the compound having a dye part changes as a result of an oxidation-reduction reaction with silver halide, or an organic silver salt at high temperature can be used, as described in Japanese Patent Application No. 165,054/84.

Still further the reducing agent may be a compound that releases a conventional photographic dye coupler or developer on oxidation as is known in the art.

The dyes formed or released in the various color-forming layers should, of course, be different. A difference of at least 60 nm in reflective maximum absorbance is preferred. More preferably, the absorbance maximum of dyes formed or released will differ by at least 80–100 nm. When three dyes are to be formed, two should preferably differ by at least these minimums, and the third should preferably differ from at least one of the other dyes by at least 150 nm, and more preferably, by at least 200 nm. Any reducing agent capable of being oxidized by silver ion to form or release a visible dye is useful in the present invention as previously noted.

The total amount of optional leuco dye used as a reducing agent used in the present invention should preferably be in the range of 0.5–25 weight percent, and more preferably, in the range of 1–10 weight percent, based upon the total weight of each individual layer in which the reducing agent is employed.

The Binder

The photosensitive silver halide, the non-photosensitive reducible source of silver, the reducing agent, and any other addenda used in the present invention are generally added to at least one binder.

The binder(s) that can be used in the present invention can be employed individually or in combination with one another. It is preferred that the binder be selected from polymeric materials, such as, for example, natural and synthetic resins that are sufficiently polar to hold the other ingredients in solution or suspension.

A typical hydrophilic binder is a transparent or translucent hydrophilic colloid. Examples of hydrophilic binders include: a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g., terpolymers, are also included in the definition of polymers. The polyvinyl acetals, such as polyvinyl butyral and polyvinyl formal, and vinyl copolymers such as polyvinyl acetate and poly(vinyl chloride are particularly preferred.

Although the binder can be hydrophilic or hydrophobic, preferably it is hydrophobic in the silver containing layer(s). Optionally, these polymers may be used in combination of two or more thereof.

The binders are preferably used at a level of about 30–90 percent by weight of the emulsion layer, and more preferably at a level of about 45–85 percent by weight. Where the proportions and activities of the reducing agent for the non-photosensitive reducible source of silver require a particular developing time and temperature, the binder should be able to withstand those conditions. Generally, it is preferred that the binder not decompose or lose its structural integrity at 250° F. (121° C.) for 60 seconds, and more preferred that it not decompose or lose its structural integrity at 350° F. (177° C.) for 60 seconds.

The polymer binder is used in an amount sufficient to carry the components dispersed therein, that is, within the effective range of the action as the binder. The effective range can be appropriately determined by one skilled in the art.

Photothermographic Formulations

The formulation for the photothermographic emulsion layer can be prepared by dissolving and dispersing the binder, the photosensitive silver halide, the non-photosensitive reducible source of silver, the reducing agent for the non-photosensitive reducible silver source, and optional additives, in an inert organic solvent, such as, for example, toluene, 2-butanone, or tetrahydrofuran.

The use of "toners" or derivatives thereof which improve the image, is highly desirable, but is not essential to the element. Toners can be present in an amount of about 0.01–10 percent by weight of the emulsion layer, preferably about 0.1–10 percent by weight. Toners are well known materials in the photothermographic art, as shown in U.S. Pat. Nos. 3,080,254; 3,847,612; and 4,123,282.

Examples of toners include: phthalimide and N-hydroxyphthalimide; cyclic imides, such as succinimide, pyrazoline-5-ones, quinazolinone, 1-phenylurazole, 3-phenyl-2-pyrazoline-5-one, and 2,4-thiazolidinedione; naphthalimides, such as N-hydroxy-1,8-naphthalimide; cobalt complexes, such as cobaltic hexamine trifluoroacetate; mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, such as (N,N-dimethylaminomethyl)phthalimide, and N-(dimethylaminomethyl)naphthalene-2,3-dicarboximide; a combination of blocked pyrazoles, isothiuronium derivatives, and certain photobleach agents, such as a combination of N,N'-hexamethylenebis(1-carbamoyl-3,5-dimethylpyrazole), 1,8-(3,6-diazaoctane)bis(isothiuronium) trifluoroacetate, and 2-(tribromomethylsulfonyl benzothiazole); merocyanine dyes such as 3-ethyl-5-[(3-ethyl- 2-benzothiazolinylidene)-1-methyl-ethylidene]-2-thio-2,4-o-azolidinqdione; phthalazinone, phthalazinone derivatives, or metal salts or these derivatives, such as 4-(1-naphthyl)phthalazinone, 6-chlorophthalazinone, 5,7-dimethoxyphthalazinone, and 2,3-dihydro-1,4-phthalazinedione; a combination of phthalazine plus one or more phthalic acid derivatives, such as phthalic acid, 4-methylphthalic acid, 4-nitrophthalic acid, and tetrachlorophthalic anhydride, quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate, and potassium hexachlororhodate (III); inorganic peroxides and persulfates, such as ammonium peroxydisulfate and hydrogen peroxide; benzoxazine-2,4-diones, such as 1,3-benzoxazine-2,4-dione, 8-methyl-1,3-benzoxazine-2,4-dione, and 6-nitro-1,3-benzoxazine-2,4-dione; pyrimidines and asymtriazines, such as 2,4-dihydroxypyrimidine, 2-hydroxy-4-aminopyrimidine, and azauracil; and tetrazapentalene derivatives, such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene.

The photothermographic elements used in this invention can be further protected against the additional production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide.

Other suitable antifoggants and stabilizers, which can be used alone or in combination, include the thiazolium salts described in U.S. Pat. Nos. 2,131,038 and U.S. Pat. No. 2,694,716; the azaindenes described in U.S. Pat. Nos. 2,886,437; the triazaindolizines described in U.S. Pat. No. 2,444,605; the mercury salts described in U.S. Pat. No. 2,728,663; the urazoles described in U.S. Pat. No. 3,287,135; the sulfocatechols described in U.S. Pat. No. 3,235,652; the oximes described in British Patent No. 623,448; the polyvalent metal salts described in U.S. Pat. No. 2,839,405; the thiuronium salts described in U.S. Pat. No. 3,220,839; and palladium, platinum and gold salts described in U.S. Pat. Nos. 2,566,263 and 2,597,915.

Photothermographic elements of the invention can contain plasticizers and lubricants such as polyalcohols and diols of the type described in U.S. Pat. No. 2,960,404; fatty acids or esters, such as those described in U.S. Pat. Nos. 2,588,765 and 3,121,060; and silicone resins, such as those described in British Patent No. 955,061.

The photothermographic elements of the present invention can also include image dye stabilizers. Such image dye stabilizers are illustrated by U.K. Patent No. 1,326,889; and U.S. Pat. Nos. 3,432,300; 3,698,909; 3,574,627; 3,573,050; 3,764,337; and 4,042,394.

In addition to the particulates used in the present invention for optical effects, the photothermographic elements according to the present invention can also contain matting agents such as starch, titanium dioxide, zinc oxide, silica, and polymeric beads including beads of the type described in U.S. Pat. Nos. 2,992,101 and 2,701,245. The beads added to the top layer in the practice of the present invention perform a dual effect in this regard.

Furthermore they can also contain antistatic or conducting layers, such as. layers that comprise soluble salts, e.g., chlorides, nitrates, etc., evaporated metal layers, ionic polymers such as those described in U.S. Pat. Nos. 2,861,056 and 3,206,312 or insoluble inorganic salts such as those described in U.S. Pat. No. 3,428,451.

Photothermographic Constructions

The photothermographic elements of this invention can be constructed of one or more layers on a support. Single layer constructions should contain the silver zhalide, the non-photosensitive, reducible silver source material, the reducing agent for the non-photosensitive reducible silver source, the binder as well as optional materials such as toners, dye-forming or dye-releasing materials, coating aids, and other adjuvants.

Two-layer constructions should contain silver halide and non-photosensitive, reducible silver source in one emulsion layer (usually the layer adjacent to the support) and some of the other ingredients in the second layer or both layers, although two layer constructions comprising a single emulsion layer coating containing all the ingredients and a protective topcoat are envisioned. Multicolor photothermographic dry silver elements can contain sets of these bilayers for each color or they can contain all ingredients within a single layer, as described in U.S. Pat. No. 4,708,928. In the case of multilayer, multicolor photothermographic elements, the various emulsion layers are generally maintained distinct from each other by the use of functional or non-functional barrier layers between the various photosensitive layers, as described in U.S. Pat. No. 4,460,681.

Barrier layers, preferably comprising a polymeric material, can also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica.

Photothermographic emulsions used in this invention can be coated by various coating procedures including wire wound rod coating, dip coating, air knife coating, curtain coating, or extrusion coating using hoppers of the type described in U.S. Pat. No. 2,681,294. If desired, two or more layers can be coated simultaneously by the procedures described in U.S. Pat. No. 2,761,791 and British Patent No. 837,095. Typical wet thickness of the emulsion layer can be about 10–150 micrometers ($\mu$m), and the layer can be dried in forced air at a temperature of about 20–100° C. It is preferred that the thickness of the layer be selected to provide maximum image densities greater than 0.2, and, more preferably, in the range 0.5 to 4.5, as measured by a MacBeth Color Densitometer Model TD 504 using the color filter complementary to the dye color.

Additionally, it may be desirable in some instances to coat different emulsion layers on both sides of a transparent support, especially when it is desirable to isolate the imaging chemistries of the different emulsion layers as disclosed in U.S. Pat. No. 5,264,321.

Development conditions will vary, depending on the construction used, but will typically involve heating the imagewise exposed material at a suitably elevated temperature. When used in a photothermographic element, the latent image obtained after exposure of the heat-sensitive element can be developed by heating the material at a moderately elevated temperature of, for example, about 80–250° C., preferably about 100–200° C., for a sufficient period of time, generally about 1 second to about 2 minutes. Heating may be carried out by the typical heating means such as a hot plate, an iron, a hot roller, a heat generator using carbon or titanium white, or the like.

The Support

Photothermographic emulsions used in the invention can be coated on a wide variety of supports. The support, or substrate, can be selected from a wide if range of materials depending on the imaging requirement. Supports may be transparent or at least translucent. Typical supports include polyester film, subbed polyester film (e.g., poly(ethylene terephthalate) or polyethylene naphthalate film), cellulose acetate film, cellulose ester film, polyvinyl acetal film, polyolefinic film (e.g., polethylene or polypropylene or blends thereof), polycarbonate film and related or resinous materials, as well as glass, paper, and the like. Typically, a flexible support is employed, especially a polymeric film support, which can be partially acetylated or coated, particularly with a polymeric subbing or priming agent. Preferred polymeric materials for the support include polymers having good heat stability, such as polyesters. Particularly preferred polyesters are poly(ethylene terephthalate) and poly(ethylene naphthalate).

A support with a backside resistive heating layer can also be used photothermographic imaging systems such as shown in U.S. Pat. No. 4,374,921.

Use as a Photomask

As noted above, the possibility of low absorbance of the photothermographic element at 380 nm in non-imaged areas facilitates the use of the photothermographic elements of the present invention in a process where there is a subsequent exposure of an ultraviolet radiation sensitive imageable medium. For example, imaging the photothermographic element with coherent radiation and subsequent development affords a visible image which is free of any visually observable woodgrain pattern. The the developed photothermographic element absorbs ultraviolet radiation in the areas where there is a visible image and transmits ultraviolet radiation where there is no visible image. The developed element may then be used as a mask and placed between an ultraviolet radiation energy source and an ultraviolet radiation photosensitive imageable medium such as, for example, a photopolymer, diazo material, or photoresist. This process is particularly useful where the imageable medium comprises a printing plate and the photothermographic element serves as an imagesetting film.

Objects and advantages of this invention will now be illustrated by the following examples, but the particular materials and amounts thereof recited in these examples, as well as other conditions and details, should not be construed to unduly limit this invention.

EXAMPLES

All materials used in the following examples were readily available from standard commercial sources such as Aldrich Chemical Co. (Milwaukee, Wis.) unless otherwise specified. The following additional terms and materials were used.

Acryloid™ A-21 is an acrylic copolymer available from Rohm and Haas, Philadelphia, Pa.

Butvar™ B-79 is a polyvinyl butyral resin available from Monsanto Company, St. Louis, Mo.

CAB 171-15S is a cellulose acetate butyrate resin available from Eastman Kodak Co.

CBBA is 2-chlorobenzoylbenzoic acid

Desmodur™ N3300 is an aliphatic triisocyanate available from Mobay Chemicals, Pittsburgh, Pa.

Gelva™ V1.5 is a polyvinyl acetate resin available from Monsanto Company, St. Louis, Mo.

MEK is methyl ethyl ketone (2-butanone).

MeOH is methanol.

MMBI is 5-methyl-2-mercaptobenzimidazole

4-MPA is 4-methylphthalic acid

Permanax™ WSO is 1,1-bis(2-hydroxy-3,5-dimethylphenyl)-3,5,5-trimethylhexane [CAS RN=7292-14-0] and is available from Vulnax International Ltd. It is also known as Nonox.

PE-2200 is a polyester resin available from Shell.

PET is polyethylene terephthalate.

PHP is pyridinium hydrobromide perbromide

PHZ is phthalazine

PSMA beads are polystearyl methacrylate beads

SF-200 is Super-Pflex™ 200, a calcium carbonate available from Specialty Minerals, Inc.

TCPA is tetrachlorophthalic acid

TCPAN is tetrachlorophthalic anhydride

THDI is Desmodur™ N-3300, a biuretized hexamathylene diisocyanate available from Mobay.

Dmin is the average of eight lowest density values on the exosed side of the fiducial mark.

Dhi is the density value corresponding to an exposure at 1.40 Log E greater than the exposure corresponding to 0.20 above Dmin. E is the exposure in ergs/cm$^2$.

Speed-2 is the Log 1/E+4 corresponding to a density of 1.00 above Dmin.

AC-1 (Average Contrast 1) is the slope of the line joining the density points 0.60 and 2.00 above Dmin.

Dmax is the highest density value on the exposed side of the fiducial mark.

Dye-1 has the structure shown below. Its preparation is disclosed in allowed co-pending U.S. patent application U.S. Ser. No. 08/202,941 (filed Feb. 28, 1994).

Dye-1

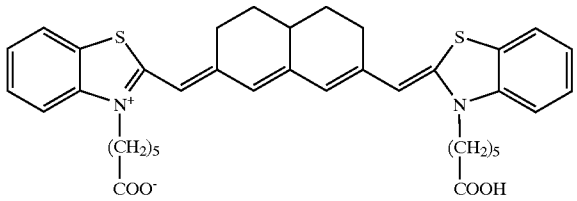

Antihalation Dye-2 has the following structure. The preparation of the antihalation Dye-2 is described in Example if of allowed copending U.S. patent application U.S. Ser. No. 08/203,120 (filed Feb. 28, 1994).

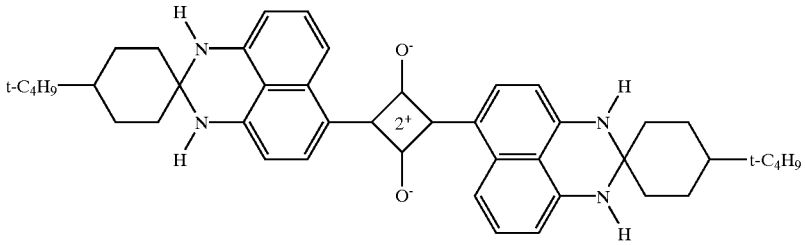

Antifoggant A is 2-(tribromomethylsulfonyl)-quinoline has the following structure:

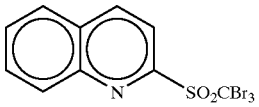

Fluorinated terpolymer A has the following random polymer structure, where m=7, n=2 and p=1. The preparation of fluorinated terpolymer A is described in allowed co-pending U.S. patent application Ser. No. 08/104,888 (filed Aug. 10, 1993).

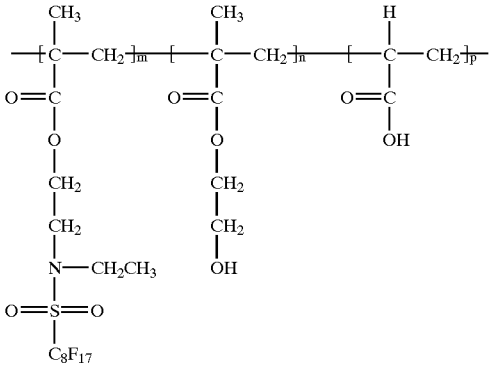

Vinyl Sulfone is described in European Laid Open Patent Application No. 0 600 589 A2 and has the following structure.

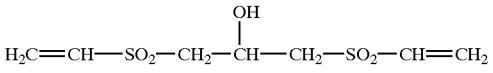

The preparation of an iridium-doped pre-formed core-shell silver iodobromide emulsion, silver soap dispersion, homogenate, and halidized homogenate solutions used in Examples 1–5 are described below.

Preparation of Iridium-Doped Pre-formed Core-Shell Silver lodobromide Emulsion

A solution was prepared by mixing the following ingredients while holding the temperature between 30–38° C.

| | |
|---|---|
| Phthalated gelation | 50 g |
| Deionized Water | 1500 mL |
| Potassium Bromide (0.1 M) | 6 mL |

The pH of the solution was adjusted to 5.0 with 3N nitric acid. The following aqueous potassium salt and silver nitrate solutions were prepared at 25° C. and jetted into the solution described above over 9.5 minutes.

| | |
|---|---|
| Potassium bromide | 27.4 g |
| Potassium iodide | 3.3 g |
| Deionized water | 275.0 g |
| Silver nitrate | 42.5 g |
| Deionized water | 364.0 g |

The pAg was held at a constant value by means of a pAg feedback control loop described in Research Disclosure No. 17,643, U.S. Pat. Nos. 3,415,650; 3,782,954; and 3,821,002.

The following two aqueous potassium salt and silver nitrate solutions were then jetted into this solution over a 28.5 minutes time interval.

| | |
|---|---|
| Potassium bromide | 179.0 g |
| Potassium iridium hexachloride | 0.010 g |
| Deionized Water | 812.0 g |
| Silver nitrate | 127.0 g |
| Deionized water | 1090.0 g |

The emulsion was washed with water and then desalted. The average grain size was 0.075 $\mu$m (micrometers) as determined by Scanning Electron Microscopy (SEM).

Preparation of Iridium-Doped Pre-formed Silver Halide/Silver Organic Salt Dispersion A silver halide/silver organic salt dispersion was prepared as described below. This material is also referred to as a silver soap dispersion or emulsion.

| | |
|---|---|
| Humko Type 9718 fatty acid (available from Witco. Co., Memphis, TN) | 118.0 g |
| Humko type 9022 fatty acid (available from Witco. Co., Memphis, TN | 570.0 g |
| Sodium Hydroxide (1.4863 m/l) | 1.5 L |
| Nitric acid (19 mL Conc. Nitric acid in 50 mL water) | 69 mL |
| Iridium-doped pre-formed core-shell emulsion (from above) (700 g/mol in 1.25 liters of water) | 0.10 mol |
| Silver Nitrate (0.859 m/L) | 2.5 L |

The fatty acids were dissolved at 80° C. in 13 liters of water and mixed for 15 minutes. A dispersion was then formed by the addition of the sodium hydroxide with mixing for 5 minutes. After the addition of the nitric acid solution, the dispersion was cooled to 55° C. and stirred for 25 minutes. While maintaining at 55° C. the iridium-doped pre-formed core shell emulsion was added and mixed for 5 minutes, followed by the addition of the silver nitrate solution and mixed for an additional 10 minutes. The dispersion was washed with water until the wash water has a resistivity of 20,000 ohm/cm$^2$. The dispersion was then dried at 45° C. for 72 hours.

Example 1

Example 1 demonstrates the reduction of woodgrain obtained when polymeric beads are incorporated into the topcoat of a photothermographic element.

Homogenization of Pre-formed Soaps (Homogenate)

A pre-formed silver fatty acid salt homogenate was prepared by homogenizing the following ingredients:

| Charge | Component | Kg | Wt % |
|---|---|---|---|
| A1 | MEK | 124.00568 | 78.1102 |
| A2 | Butvar ™ B-79 | 1.74633 | 1.1000 |
| A3 | Ag Soap* | 33.00533 | 20.7898 |
| A | Total Homogenate | 158.75734 | 100.0000 |

*Iridium-doped pre-formed silver halide/silver organic salt dispersion from above.

The ingredients above were mixed at 21° C. for 10 minutes and held for 24 hours. The mixture was homogenized at 4000 psi and then again at 8000 psi.

The following ingredients were sequentially added and mixed to provide a photothermographic silver emulsion coating solution.

Photothermographic Silver Emulsion Coating Solution

| Charge | Component | Kg | Wt % |
|---|---|---|---|
| A | Homogenate | 58.57592 | 64.8103 |
| B | MEK | 3.27730 | 3.6261 |
| C1 | PHP | 0.08600 | 0.0952 |
| C2 | MeOH | 0.24340 | 0.2693 |
| D1 | $CaBr_2$ | 0.06559 | 0.0726 |
| D2 | MeOH | 0.37140 | 0.4109 |
| E1 | MMBI | 0.04073 | 0.0451 |
| E2 | CBBA | 0.45187 | 0.5000 |
| E3 | Dye-1 | 0.00835 | 0.0092 |
| E4 | MeOH | 2.93901 | 3.2518 |
| F | Butvar ™ B-79 | 14.75010 | 16.3200 |
| G1 | Antifoggant A | 0.34999 | 0.3872 |
| G2 | MEK | 4.02509 | 4.4535 |
| H | Permanax ™ WSO | 3.02925 | 3.3517 |
| I1 | THDI | 0.17853 | 0.1975 |
| 12 | MEK | 0.08927 | 0.0988 |
| J1 | TCPA | 0.10002 | 0.1107 |
| J2 | MEK | 0.31634 | 0.3500 |
| K1 | PHZ | 0.30013 | 0.3321 |
| K2 | MEK | 1.18224 | 1.3081 |
| Total Silver Trip Dispersion | | 90.38053 | 100.0000 |

The following ingredients were sequentially added and mixed to provide a topcoat solution for coating.

| Charge | Component | Kg | Wt % |
|---|---|---|---|
| | Topcoat 1a - Topcoat Solution Without Beads (Control) | | |
| A | MeOH | 3.59979 | 9.9202 |
| B | MEK | 20.91768 | 57.6444 |
| C | TCPAN | 0.04129 | 0.1138 |
| D | CAB 171-15S | 4.31380 | 11.8879 |
| E1 | MEK | 3.21142 | 8.8500 |
| E2 | Acryloid ™ A-21 | 0.17451 | 0.4809 |
| E3 | 4-MPA | 0.17296 | 0.4766 |
| F1 | MEK | 3.21144 | 8.8500 |
| F2 | CAB 171-15S | 0.22041 | 0.6074 |
| F3 | SF-200 ($CaCO_3$) | 0.11020 | 0.3037 |
| G | Fluorinated terpolymer A | 0.31392 | 0.8651 |
| Total Topcoat Trip Solution | | 36.28742 | 100.0000 |
| | Topcoat 1b - Topcoat Solution with Beads | | |
| A | MeOH | 1.00695 | 9.3701 |
| B | MEK | 5.85118 | 54.4476 |
| C | TCPAN | 0.01155 | 0.1075 |
| D | CAB 171-15S | 1.20667 | 11.2286 |
| E1 | MEK | 0.89831 | 8.3592 |
| E2 | Acryloid ™ A-21 | 0.04882 | 0.4542 |
| E3 | 4-MPA | 0.04838 | 0.4502 |
| F | Fluorinated terpolymer A | 0.08781 | 0.8171 |
| G1 | MEK | 0.22456 | 2.0896 |
| G2 | CAB 171-15S | 0.01027 | 0.0956 |
| G3 | 2 μm PSMA Beads | 0.06298 | 0.5860 |
| H1 | MEK | 0.67373 | 6.2694 |
| H2 | CAB 171-15S | 0.03083 | 0.2869 |
| H3 | 8 μm PSMA Beads | 0.11468 | 1.0671 |
| I1 | MEK | 0.44918 | 4.1798 |
| I2 | CAB 171-15S | 0.02055 | 0.1912 |
| Total Topcoat Trip Solution | | 10.74645 | 100.0000 |

The photothermographic silver emulsion coating dispersion and the topcoat solutions were dual coated onto a 7 mil (0.18 mm) unprimed blue tinted polyester support. The coating weight of the photothermographic silver emulsion was 2.20 g/ft$^2$ (23.7 g/m$^2$) and the coating weight of the topcoat solutions were 0.24 g/ft$^2$ (2.58 g/m$^2$) . The coatings were dried for 2–3 minutes at 82° C. (180° F.).

Samples of the coatings of Example 1 were cut into 3.5 cm×21.5 cm strips. The strips were exposed through a laser sensitometer at 811 nm. The exposed strips were processed for 15 seconds at 255° F. (124° C.) in a hot roll processor. Sensitometry measurements were made on a custom-built, computer-scanned densitometer and are believed to be comparable to measurements obtainable from commercially available densitometers. Sensitometric results include Dmin, Dmax, Speed, and Contrast.

The haze level of the coating was measured for each sample using a Gardner Haze Meter XL-211 Model 8011.

Example 1C is the control and Example 1 is the sample of this invention. The following results were obtained:

| Ex. | % Haze | Dmin | Dhi | Speed-3 | AC-1 | Dmax |
|---|---|---|---|---|---|---|
| 1C | 17.4 | 0.22 | 3.91 | 1.76 | 4.53 | 3.96 |
| 1 | 21.8 | 0.22 | 3.93 | 1.69 | 4.39 | 4.02 |

The presence and severity of woodgrain was determined by preparing "greyouts." Greyouts are samples that have been uniformly exposed to light and developed so that the samples have a uniform Optical Density, for example between 1.0 and 2.0. They visually appear to have a uniform grey appearance.

Greyouts were prepared using a laser diode emitting at 811 nm with a power of 150 mWatt. Image information was digitized and converted into signal that modulated a laser beam to expose the photothermographic element to achieve a uniform optical density of about 1.8. Scanning was accomplished by a galvanometer or a scanning mirror. The sample remained stationary and the laser scanned across the sample with an overlapping raster pattern. After scanning, the samples were developed at 255° F. (124° C.) for 15 seconds by heating on a rotating drum thermal processor.

Greyouts effected by laser exposure were compared with greyouts obtained by uniformly exposing identical samples to a white incandescent light source that also emitted in the infrared. This latter type of exposure is also referred to as a "floodlight" exposure or a "blanket" exposure. Again, exposure conditions were adjusted so that greyouts had a uniform Optical Density of about 1.8.

The amount of woodgrain present was subjectively determined by comparing samples placed on a X-ray view box. Woodgrain was rated as high, medium, or low.

| Sample Rating | Exposure Method | Woodgrain |
|---|---|---|
| With Beads | Scanning Laser | Low Woodgrain |
| No Beads (Control) | Scanning Laser | High Woodgrain |
| With Beads | Blanket Exposure | No Woodgrain |
| Control No Beads | Blanket Exposure | No Woodgrain |

Example 2

Example 2 demonstrates the reduction of woodgrain obtained when the support is coated with a polyester primer coating in an attempt to provide a graded transition between the refractive index of the support to the refractive index of the emulsion layer.

Homogenization of Pre-formed Soaps (Homogenate)

A pre-formed silver fatty acid salt homogenate was prepared by homogenizing the following ingredients:

| Charge | Component | Kg | Wt % |
|---|---|---|---|
| A1 | MEK | 99.86743 | 78.1103 |
| A2 | Butvar ™ TM B-79 | 1.40640 | 1.1000 |
| A3 | Ag Soap* | 26.58051 | 20.7897 |
| A | Total Homogenate | 127.85434 | 100.0000 |

*Iridium-doped pre-formed silver halide/silver organic salt dispersion from above.

The ingredients above were mixed at 21° C. for 10 minutes and held for 24 hours. The mixture was homogenized at 4000 psi and then again at 8000 psi.

The following ingredients were sequentially added and mixed to provide a photothermographic silver emulsion coating solution.

Photothermographic Silver Emulsion Coating Solution

| Charge | Component | Kg | Wt % |
|---|---|---|---|
| A | Homogenate | 85.84068 | 63.0529 |
| B | MEK | 4.17609 | 3.0675 |
| C1 | PHP | 0.12600 | 0.0926 |
| C2 | MeOH | 0.35667 | 0.2620 |
| D1 | $CaBr_2$ | 0.09606 | 0.0706 |
| D2 | MeOH | 0.54432 | 0.3998 |
| E1 | MMBI | 0.05973 | 0.0439 |
| E2 | CBBA | 0.66216 | 0.4864 |
| E3 | Dye-1 | 0.01224 | 0.0090 |
| E4 | MeOH | 4.30698 | 3.1636 |
| F | Butvar ™ B-79 | 21.45224 | 15.7574 |
| G1 | Antifoggant A | 0.51288 | 0.3767 |
| G2 | MEK | 5.89857 | 4.3327 |
| H | Permanax ™ WSO | 4.93254 | 3.6231 |
| I1 | THDI | 0.26166 | 0.1922 |
| I2 | MEK | 0.13077 | 0.0961 |
| J1 | TCPA | 0.16290 | 0.1197 |
| J2 | MEK | 0.46362 | 0.3405 |
| K1 | PHZ | 0.48867 | 0.3589 |
| K2 | MEK | 1.73253 | 1.2726 |
| L1 | Butvar ™ B-79 | 0.16343 | 0.1200 |
| L2 | PE2200 | 1.12799 | 0.8285 |
| L3 | MEK | 2.631972 | 1.9333 |
| Total Silver Trip Dispersion | | 136.14070 | 100.0000 |

The following ingredients were sequentially added and mixed to provide a topcoat solution for coating.

Topcoat 2 - Topcoat Solution

| Charge | Component | Kg | Wt % |
|---|---|---|---|
| A | MeOH | 13.48666 | 9.9110 |
| B | MEK | 78.26115 | 57.5123 |
| C | Vinyl Sulfone | 0.22930 | 0.1685 |
| D | CAB 171-15S | 16.19325 | 11.9000 |
| E | Fluorinated terpolymer A | 1.17639 | 0.8645 |
| F1 | MEK | 12.11309 | 8.9016 |
| F2 | Acryloid ™ A-21 | 0.65393 | 0.4806 |
| F3 | 4-MPA | 0.63817 | 0.4690 |
| G1 | MEK | 12.11309 | 8.9016 |
| G2 | CAB 171-15S | 0.79864 | 0.5869 |
| G3 | SF-200 ($CaCO_3$) | 0.41357 | 0.3039 |
| Total Topcoat Trip Solution | | 136.07724 | 100.0000 |

The following ingredients were sequentially added and mixed to provide a primer solution for the support.

Primer Solution - PE-2200

| Charge | Component | Kg | Wt % |
|---|---|---|---|
| A | MEK | 30.00000 | 58.6667 |
| B | PE2200 | 4.09091 | 8.0000 |
| C | Toluene | 17.04545 | 33.3333 |
| Total Primer Layer Solution | | 51.13636 | 100.0000 |

One sample of a 7 mil (0.18 mm) unprimed blue tinted polyester support was coated with the PE-2200 polyester primer solution at a coating weight of 0.18 g/ft$^2$ (1.94 g/m$^2$). A second sample remained unprimed. The photothermographic emulsion silver trip dispersion and the topcoat solutions were dual coated onto the primed and unprimed supports. The coating weight of the photothermographic silver emulsion was 2.20 g/ft$^2$ (23.7 g/m$^2$) and the coating weight of the topcoat solution was 0.24 g/ft$^2$ (2.58 g/m$^2$). The coatings were dried for 2–3 minutes at 82° C. (180° F.). Example 2C is the control and Example 2 is the sample of this invention.

Sensitometry of the samples were evaluated as described in Example 1 above. The following results were obtained:

| Ex. | Dmin | Dhi | Speed-3 | AC-1 | Dmax |
|---|---|---|---|---|---|
| 2C | 0.30 | 3.63 | 1.94 | 4.34 | 3.80 |
| 2 | 0.30 | 3.77 | 1.88 | 4.31 | 3.92 |

The presence and severity of woodgrain were determined by preparing "greyouts" as described in Example 1 above. Again, exposure conditions were adjusted so that greyouts had a uniform Optical Density of about 1.8.

The amount of woodgrain present was subjectively determined by comparing samples placed on a X-ray view box. Woodgrain was rated as high, medium, or low.

| Sample Rating | Exposure Method | Woodgrain |
|---|---|---|
| With primer | Scanning Laser | Low Woodgrain |
| No primer (Control) | Scanning Laser | High Woodgrain |
| With primer | Blanket Exposure | No Woodgrain |
| Control No primer | Blanket Exposure | No Woodgrain |

Example 3

Example 3 demonstrates the reduction of woodgrain obtained when a support is coated with a primer layer also containing particles such as polymeric beads. Again, this is an experiment to provide a graded transition between the refractive index of the support and the refractive index of the emulsion layer along with particles capable of providing diffuse reflection.

Homogenization of Pre-formed Soaps (Homogenate)

A pre-formed silver fatty acid salt homogenate was prepared by homogenizing the following ingredients:

| Charge | Component | Kg | Wt % |
|---|---|---|---|
| A1 | MEK | 124.00568 | 78.1102 |
| A2 | Butvar ™ B-79 | 1.74633 | 1.1000 |
| A3 | Ag Soap* | 33.00533 | 20.7898 |
| A | Total Homogenate | 100.000 | 100.0000 |

*Iridium-doped pre-formed silver halide/silver organic salt dispersion from above.

The ingredients above were mixed at 21° C. for 10 minutes and held for 24 hours. The mixture was homogenized at 4000 psi and then again at 8000 psi.

The following ingredients were sequentially added and mixed to provide a photothermographic silver emulsion coating solution.

Photothermographic Silver Emulsion Coating Solution

| Charge | Component | Kg | Wt % |
|---|---|---|---|
| A | Homogenate | 85.84068 | 63.0529 |
| B | MEK | 4.17609 | 3.0675 |
| C1 | PHP | 0.12600 | 0.0926 |
| C2 | MeOH | 0.35667 | 0.2620 |
| D1 | $CaBr_2$ | 0.09606 | 0.0706 |
| D2 | MeOH | 0.54432 | 0.3998 |
| E1 | MMBI | 0.05973 | 0.0439 |
| E2 | CBBA | 0.66216 | 0.4864 |
| E3 | Dye-1 | 0.01224 | 0.0090 |
| E4 | MeOH | 4.30698 | 3.1636 |
| F | Butvar ™ B-79 | 21.45224 | 15.7574 |
| G1 | Antifoggant A | 0.51288 | 0.3767 |
| G2 | MEK | 5.89857 | 4.3327 |
| H | Permanax ™ WSO | 4.93254 | 3.6231 |
| I1 | THDI | 0.26166 | 0.1922 |
| I2 | MEK | 0.13077 | 0.0961 |
| J1 | TCPA | 0.16290 | 0.1197 |
| J2 | MEK | 0.46362 | 0.3405 |
| K1 | PHZ | 0.48867 | 0.3589 |
| K2 | MEK | 1.73253 | 1.2726 |
| L1 | Butvar ™ B-79 | 0.16343 | 0.1200 |
| L2 | PE2200 | 1.12799 | 0.8285 |
| L3 | MEK | 2.631972 | 1.9333 |
| Total Silver Trip Dispersion | | 136.14070 | 100.0000 |

The following ingredients were sequentially added and mixed to provide a topcoat solution for coating.

Topcoat 2 - Topcoat Solution

| Charge | Component | Kg | Wt % |
|---|---|---|---|
| A | MeOH | 13.48666 | 9.9110 |
| B | MEK | 78.26115 | 57.5123 |
| C | Vinyl Sulfone | 0.22930 | 0.1685 |
| D | CAB 171-15S | 16.19325 | 11.9000 |
| E | Fluorinated terpolymer A | 1.17639 | 0.8645 |
| F1 | MEK | 12.11309 | 8.9016 |
| F12 | Acryloid ™ A-21 | 0.65393 | 0.4806 |
| F3 | 4-MPA | 0.63817 | 0.4690 |
| G1 | MEK | 12.11309 | 8.9016 |
| G2 | CAB 171-15S | 0.79864 | 0.5869 |
| G3 | SF-200 ($CaCO_3$) | 0.41357 | 0.3039 |
| Total Topcoat Trip Solution | | 136.07724 | 100.0000 |

The following ingredients were sequentially added and mixed to provide a primer solution for the support.

Primer Solution - PE-2200 + polymeric Beads

| Charge | Component | Kg | Wt % |
|---|---|---|---|
| A | MEK | 10.00000 | 58.4334 |
| B | PE2200 | 1.36364 | 7.9682 |
| C | Toluene | 5.68182 | 33.2008 |
| D | PSMA-8 (8 $\mu$m beads) | 0.06804 | 0.3976 |
| Total | Primer Layer Solution | 17.11349 | 100.0000 |

One sample of a 7 mil (0.18 mm) unprimed blue tinted polyester support was coated with the PE-2200 polyester primer solution containing 8 $\mu$m PSMA-8 beads at a coating weight of 0.18 g/ft$^2$ (1.94 g/m$^2$). A second sample remained unprimed. The photothermographic silver emulsion coating dispersion and the topcoat solutions were dual coated onto the primed and unprimed supports. The coating weight of the photothermographic silver emulsion was 2.20 g/ft$^2$ (23.7 g/m$^2$) and the coating weight of the topcoat solutions were 0.24 9/ft$^2$ (2.58 g/m$^2$). The coatings were dried for 2–3 minutes at 82° C. (180° F.). Example 3C is the control and Example 3 is the sample of this invention.

Sensitometry of the samples were evaluated as described in Example 1 above. The following results were obtained:

| Ex. | Dmin | Dhi | Speed-3 | AC-1 | Dmax |
|---|---|---|---|---|---|
| 3C | 0.30 | 3.63 | 1.94 | 4.34 | 3.80 |
| 3 | 0.30 | 3.74 | 1.88 | 3.27 | 3.87 |

The presence and severity of woodgrain were determined by preparing "greyouts" as described above in Example 1. Again, exposure conditions were adjusted so that greyouts had a uniform Optical Density of about 1.8.

The amount of woodgrain present was subjectively determined by comparing samples placed on a X-ray view box. Woodgrain was rated as high, medium, or low.

| Sample Rating | Exposure Method | Woodgrain |
|---|---|---|
| With Primer + Beads | Scanning Laser | Low Woodgrain |
| No Primer (Control) | Scanning Laser | High Woodgrain |
| With Primer + Beads | Blanket Exposure | No Woodgrain |
| Control No Primer | Blanket Exposure | No Woodgrain |

Example 4

Example 4 demonstrates the woodgrain reduction when an Acutance Dye is contained in the topcoat layer of the photothermographic element. It has been determined that the acutance dye migrates into the emulsion layer during coating and drying.

Homogenization of Pre-formed Soaps (Homogenate)

A pre-formed silver fatty acid salt homogenate was prepared by homogenizing the following ingredients:

| Charge | Component | Kg | Wt % |
|---|---|---|---|
| A1 | MEK | 124.00568 | 78.1102 |
| A2 | Butvar ™ B-79 | 1.74633 | 1.1000 |
| A3 | Ag Soap* | 33.00533 | 20.7898 |
| A | Total Homogenate | 158.75734 | 100.0000 |

*Iridium-doped pre-formed silver halide/silver organic salt dispersion from above.

The ingredients above were mixed at 21° C. for 10 minutes and held for 24 hours. The mixture was homogenized at 4000 psi and then again at 8000 psi.

The following ingredients were sequentially added and mixed to provide a photothermographic silver emulsion coating solution.

| Photothermographic Silver Emulsion Coating Solution | | | |
|---|---|---|---|
| Charge | Component | Kg | Wt % |
| A | Homogenate | 65.89785 | 64.5383 |
| B | MEK | 3.68696 | 3.6109 |
| C1 | PHP | 0.09674 | 0.0947 |
| C2 | MeOH | 0.27380 | 0.2682 |
| D1 | $CaBr_2$ | 0.07375 | 0.0722 |
| D2 | MeOH | 0.41785 | 0.4092 |
| E1 | MMBI | 0.04586 | 0.0449 |
| E2 | CBBA | 0.50832 | 0.4978 |
| E3 | Dye-1 | 0.00940 | 0.0092 |
| E4 | MeOH | 3.30638 | 3.2382 |
| F | Butvar ™ B-79 | 16.59384 | 16.2515 |
| G1 | Antifoggant-A | 0.39372 | 0.3856 |
| G2 | MEK | 4.52819 | 4.4348 |
| H | Permanax ™ WSO | 3.78660 | 3.7085 |
| I1 | THDI | 0.20088 | 0.1967 |
| I2 | MEK | 0.10039 | 0.0983 |
| J1 | TCPA | 0.12504 | 0.1225 |
| J2 | MEK | 0.35591 | 0.3486 |
| K1 | PHZ | 0.37513 | 0.3674 |
| K2 | MEK | 1.33003 | 1.3026 |
| Total Silver Trip Dispersion | | 102.10664 | 100.0000 |

The following ingredients were sequentially added and mixed to provide a topcoat solution for coating.

| Topcoat - Topcoat Solution | | | |
|---|---|---|---|
| Charge | Component | Kg | Wt % |
| A | MeOH | 13.48666 | 9.9110 |
| B | MEK | 78.26115 | 57.5123 |
| C | Vinyl Sulfone | 0.22930 | 0.1685 |
| D | Cab 171-15S | 16.19325 | 11.9000 |
| E | Fluorinated terpolymer A | 1.17639 | 0.8645 |
| F1 | MEK | 12.11309 | 8.9016 |
| F2 | Acryloid ™ A-21 | 0.65393 | 0.4806 |
| F3 | 4-MPA | 0.63817 | 0.4690 |
| G1 | MEK | 12.11309 | 8.9016 |
| G2 | CAB 171-15S | 0.79864 | 0.5869 |
| G3 | SF-200 ($CaCO_3$) | 0.41357 | 0.3039 |
| Total Topcoat Trip Solution | | 136.07724 | 100.0000 |

A topcoat solution containing acutance Dye-2 was prepared by sequentially adding and mixing the ingredients shown below.

| Topcoat - Topcoat Solution Containing Acutance Dye | | | |
|---|---|---|---|
| Charge | Component | Kg | Wt % |
| A | Topcoat Trip Solution from above | 9.07185 | 93.5257 |
| B | MeOH | 0.60000 | 6.1857 |
| C | Dye-2 | 0.02800 | 0.2887 |
| Total Topcoat Trip Solution | | 9.69985 | 100.0000 |

One photothermographic element was prepared by dual coating 7 mil (0.18 mm) unprimed blue tinted polyester support with the photothermographic silver emulsion coating dispersion and topcoat solution containing no acutance dye. Another photothermographic element was prepared by dual coating 7 mil (0.18 mm) unprimed blue tinted polyester support with the photothermographic silver emulsion coating dispersion and topcoat solution containing acutance Dye-2. The coating weight of the photothermographic silver emulsion was 2.20 g/ft$^2$ (23.7 g/m$^2$) and the coating weight of the topcoat solutions were 0.24 g/ft$^2$ (2.58 g/m$^2$). The coatings were dried for 2–3 minutes at 82° C. (180° F.). Example 4C is the control and Example 4 is the sample of this invention.

Sensitometry of the samples were evaluated as described in Example 1 above. The following results were obtained:

| Ex. | Dmin | Dhi | Speed-3 | AC-1 | Dmax |
|---|---|---|---|---|---|
| 4C | 0.23 | 3.94 | 1.85 | 4.78 | 4.07 |
| 4 | 0.40 | — | 1.32 | 3.73 | 3.55 |

The presence and severity of woodgrain were determined by preparing "greyouts" as described in Example 1. Again, exposure conditions were adjusted so that greyouts had a uniform Optical Density of about 1.8.

The amount of woodgrain present was subjectively determined by comparing samples placed on a X-ray view box. Woodgrain was rated as high, medium, or low.

| Sample Rating | Exposure Method | Woodgrain |
|---|---|---|
| With Acutance Dye | Scanning Laser | Low Woodgrain |
| Control (No Dye) | Scanning Laser | High Woodgrain |
| With Acutance Dye | Blanket Exposure | No Woodgrain |
| Control (No Dye) | Blanket Exposure | No Woodgrain |

Example 5

Example 5 demonstrates the woodgrain reduction when a polyester resin is used in the emulsion layer of the photothermographic element. The polyester resin used was Shell PE-2200.

Homogenization of Pre-formed Soaps (Homogenate)

A pre-formed silver fatty acid salt homogenate was prepared by homogenizing the following ingredients:

| Charge | Component | Kg | Wt % |
|---|---|---|---|
| A1 | MEK | 122.24791 | 77.0030 |
| A2 | Butvar ™ B-79 | 3.50409 | 2.2072 |
| A3 | Ag Soap* | 33.00533 | 20.7898 |
| A | Total Homogenate | 158.7573 | 100.0000 |

*Iridium-doped pre-formed silver halide/silver organic salt dispersion from above.

The ingredients above were mixed at 21° C. for 10 minutes and held for 24 hours. The mixture was homogenized at 4000 psi and then again at 8000 psi.

The following ingredients were sequentially added and mixed to provide a photothermographic silver emulsion coating dispersion.

Photothermographic Silver Emulsion Coating Dispersion

| Charge | Component | Kg | Wt % |
|---|---|---|---|
| A | Homogenate | 28.78225 | 63.4540 |
| B | MEK | 2.84861 | 6.2801 |
| C1 | PHP | 0.02087 | 0.0460 |
| C2 | MeOH | 0.11825 | 0.2607 |
| D1 | $CaBr_2$ | 0.03184 | 0.0702 |
| D2 | MeOH | 0.18048 | 0.3979 |
| E1 | MMBI | 0.01978 | 0.0436 |
| E2 | CBBA | 0.21954 | 0.4840 |
| E3 | Dye-1 | 0.00408 | 0.0090 |
| E4 | MeOH | 1.43902 | 3.1725 |
| F | Butvar ™ B-79 | 6.84435 | 15.0892 |
| G1 | Antifoggant 1 | 0.17005 | 0.3749 |
| G2 | MEK | 1.95566 | 4.3115 |
| H | Permanax ™ WSO | 1.63538 | 3.6054 |
| I1 | THDI | 0.09657 | 0.2129 |
| I2 | MEK | 0.04831 | 0.1065 |
| J1 | TCPA | 0.05402 | 0.1191 |
| J2 | MEK | 0.15372 | 0.3389 |
| K1 | PHZ | 0.16202 | 0.3572 |
| K2 | MEK | 0.57443 | 1.2664 |
| Total Silver Trip Dispersion | | 45.35923 | 100.0000 |

The following ingredients were sequentially added and mixed to provide a topcoat solution for coating.

Topcoat Solution

| Charge | Component | Kg | Wt % |
|---|---|---|---|
| A | MeOH | 13.57770 | 9.9826 |
| B | MEK | 78.83349 | 57.9602 |
| C | TCPAN | 0.14968 | 0.1100 |
| D | CAB 171-15S | 15.63165 | 11.4927 |
| E | Fluorinated terpolymer A | 1.13747 | 0.8363 |
| F1 | MEK | 12.11309 | 8.9058 |
| F2 | Acryloid ™ A-21 | 0.63235 | 0.4649 |
| F3 | 4-MPA | 0.62664 | 0.4607 |
| G1 | MEK | 12.11309 | 8.9058 |
| G2 | CAB 171-15S | 0.79864 | 0.5872 |
| G3 | SF-200 $CaCO_3$ | 0.39939 | 0.2936 |
| Topcoat Trip Solution | | 136.01319 | 100.0000 |

The following ingredients were sequentially added and mixed to provide a photothermographic silver emulsion coating dispersion containing a polyester resin in the emulsion layer of the photothermographic element.

Photothermographic Silver Emulsion Coating Dispersion

| Charge | Component | Kg | Wt % |
|---|---|---|---|
| A | Homogenate | 28.78225 | 60.5990 |
| B | MEK | 2.84861 | 5.9975 |
| C1 | PHP | 0.02087 | 0.0439 |
| C2 | MeOH | 0.11825 | 0.2490 |
| D1 | $CaBr_2$ | 0.03184 | 0.0670 |
| D2 | MeOH | 0.18048 | 0.3800 |
| E1 | MMBI | 0.01978 | 0.0416 |
| E2 | CBBA | 0.21954 | 0.4622 |
| E3 | Dye-1 | 0.00408 | 0.0086 |
| E4 | MeOH | 1.43902 | 3.0298 |
| F | Butvar ™ B-79 | 6.84435 | 14.4103 |
| G1 | Antifoggant A | 0.17005 | 0.3580 |
| G2 | MEK | 1.95566 | 4.1175 |

-continued

Photothermographic Silver Emulsion Coating Dispersion

| Charge | Component | Kg | Wt % |
|---|---|---|---|
| H | Permanax ™ WSO | 1.63538 | 3.4432 |
| I1 | THDI | 0.09657 | 0.2033 |
| I2 | MEK | 0.04831 | 0.1017 |
| J1 | TCPA | 0.05402 | 0.1137 |
| J2 | MEK | 0.15372 | 0.3236 |
| K1 | PHZ | 0.16202 | 0.3411 |
| K2 | MEK | 0.57443 | 1.2094 |
| L1 | PE-2200 | 0.74797 | 1.5748 |
| L2 | MEK | 1.38908 | 2.9246 |
| Total Silver Trip Dispersion | | 47.49628 | 100.0000 |

The following ingredients were sequentially added and mixed to provide a topcoat solution for coating.

Topcoat Solution

| Charge | Component | Kg | Wt % |
|---|---|---|---|
| A | MeOH | 13.57770 | 9.9826 |
| B | MEK | 78.83349 | 57.9602 |
| C | TCPAN | 0.14968 | 0.1100 |
| D | CAB 171-15S | 15.63165 | 11.4927 |
| E | Fluorinated terpolymer A | 1.13747 | 0.8363 |
| F1 | MEK | 12.11309 | 8.9058 |
| F2 | Acryloid ™ A-21 | 0.63235 | 0.4649 |
| F3 | 4-MPA | 0.62664 | 0.4607 |
| G1 | MEK | 12.11309 | 8.9058 |
| G2 | CAB 171-15S | 0.79864 | 0.5872 |
| G3 | SF-200 $CaCO_3$ | 0.39939 | 0.2936 |
| Topcoat Trip Solution | | 136.01319 | 100.0000 |

One photothermographic element was prepared by dual coating 7 mil (0.18 mm) unprimed blue tinted polyester support with the photothermographic silver emulsion coating dispersion containing no polyester resin in the emulsion layer and topcoat solution. Another photothermographic element was prepared by dual coating 7 mil (0.18 mm) unprimed blue tinted polyester support with the photothermographic silver emulsion coating dispersion containing PE-2200 polyester resin and topcoat solution. The coating weight of the photothermographic silver emulsion was 2.20 $g/ft^2$ (23.7 $g/m^2$) and the coating weight of the topcoat solutions were 0.24 $g/ft^2$ (2.58 $g/m^2$) . The coatings were dried for 2–3 minutes at 82° C. (180° F.). Example 5C is the control and Example 5 is the sample of this invention.

Sensitometry of the samples and haze were evaluated as described in Example 1 above. The following results were obtained:

| Ex. | % Haze | Dmin | Dhi | Speed-3 | AC-1 | Dmax |
|---|---|---|---|---|---|---|
| 5C | 15.5 | 0.22 | 3.89 | 1.73 | 4.43 | 4.12 |
| 5 | 22.9 | 0.22 | 3.64 | 1.60 | 4.22 | 3.79 |

The presence and severity of woodgrain were determined by preparing "greyouts" as described in Example 1. Again, exposure conditions were adjusted so that greyouts had a uniform Optical Density of about 1.8.

The amount of woodgrain present was subjectively determined by comparing samples placed on a X-ray view box. Woodgrain was rated as high, medium, or low.

| Sample Rating | Exposure Method | Woodgrain |
|---|---|---|
| With PE-2200 Resin | Scanning Laser | Low woodgrain |
| Control (No Resin) | Scanning Laser | High Woodgrain |
| With PE-2200 Resin | Blanket Exposure | No Woodgrain |
| Control (No Resin) | Blanket Exposure | No Woodgrain |

Reasonable modifications and variations are possible from the foregoing disclosure without departing form either the spirit or scope of the present invention as defined by the claims.

What is claimed is:

1. A spectrally sensitized photothermographic silver halide element comprising a transparent support layer having on at least one surface thereof a photothermographic emulsion layer having a total uniform thickness of from 10 to 40 μm, said thickness having no variation greater than 10 to 200 nm, said photothermographic emulsion layer comprising a binder, a light insensitive silver source, a reducing agent for silver ion and radiation sensitive silver halide grains, which element displays uniform image density across its surface when exposed to floodlight or uniform incandescent light exposure at a wavelength of radiation to which the photothermographic emulsion layer is sensitive, said uniform image density meaning a variation in optical density of no more than 5% at a gray out optical density of from 1.5 to 1.9 between adjacent areas of 1 $mm^2$ of said photothermographic emulsion layer surface, said photothermographic element comprising at least two layers, including a top layer having a uniform thickness of from 0.5 to 6 μm, and said photothermographic emulsion layer, wherein said at least two layers have been applied to said transparent support layer simultaneously using a machine coating apparatus; and wherein:

1) the top layer of the element has haze induced therein of 0.05 to 30%, 2) there is a random refractive pattern on the top layer, 3) there is haze in the photothermographic emulsion layer caused by optically transparent particulates, 4) the reflective characteristics of a surface of said transparent support layer facing the photothermographic emulsion layer have been altered to reduce reflection of coherent radiation into said emulsion layer, or 5) said element having acutance dyes in said photothermographic emulsion layer that absorb radiation to which said photothermographic emulsion layer is sensitive.

2. The element of claim 1 wherein said silver halide grains are pre-formed silver halide grains which have a number average particle size of <0.10 μm with at least 80% of all grains with +0.05 μm of the average.

3. The element of claim 2 which also comprises an antihalation layer having an absorbance ratio of IR absorbance (before exposure)/visible absorbance (after processing) >30, and an IR absorbance of at least 0.3 within the range of 750–1400 and an optical density of less than 0.03 in the visible region.

4. The element of claim 1 wherein there is haze in said top layer and said haze in said top layer is provided by the presence of particles in said top layer, said particles having a number average size of 0.5 to 12 μm.

5. The element of claim 1 wherein the number average size of the silver halide grains is between 0.01 and 0.08 μm.

6. The element of claim 1 wherein the number average size of the silver halide grains is between 0.03 and 0.07 μm.

7. The element of claim 1 wherein the number average size of the silver halide grains is between 0.04 and 0.06 μm.

8. The element of claim 1, which without exposure and after thermal development for thirty seconds at 140° C. has an optical density at 380 nm of less than 0.1.

9. The element of claim 1, in which said support layer comprises a transparent organic polyester layer.

10. The element of claim 1 wherein said top layer provides a level of haze between 0.5 and 30% to said element.

11. The element of claim 10 wherein haze is provided in said topcoat by the presence of particulates in said topcoat and said haze in said topcoat has a value between 0.5 and 10%.

12. The element of claim 1 wherein the reflective properties of the support are changed by having a coating on a support layer, the refractive index of the coating being at least 0.02 closer to the refactive index of said composition than is the refractive index of the support layer.

13. The element of claim 1 wherein the refractive pattern of the top layer is altered from planarity at least by raised areas in said top layer resulting at least in part by displacement of mass from the top layer by particulates other than silver containing materials within the composition.

14. A spectrally sensitized photothermographic silver halide element comprising a transparent support having on at least one surface thereof a photothermographic emulsion layer having a total uniform thickness of from 10 to 40 μm, said thickness having no variation greater than 10 to 200 nm, said photothermographic emulsion layer comprising a binder, a light insensitive silver source, a reducing agent for silver ion, and radiation sensitive silver halide grains, which photothermographic emulsion layer displays uniform image density across its surface when exposed to floodlight or uniform incandescent light exposure at a wavelength of radiation to which the photothermographic layer is sensitive, and said element displaying less than 0.05 variation in average optical density amongst any three linearly consecutive areas defined by squares of from 0.5 $mm^2$ to 5 $cm^2$ when said element is uniformly exposed over its entire surface to coherent radiation to which said element is spectrally sensitive, said photothermographic element including a top layer having a uniform thickness of from 0.5 to 6 μm, wherein said photothermographic emulsion layer and top layer have been applied to said transparent support layer simultaneously using a machine coating apparatus.

15. The element of claim 14 wherein said three linearly consecutive areas are squares of 1 $mm^2$.

16. The element of claim 14 wherein said top layer displays a first spatial frequency of variations in a first property that alters light refraction and light reflection, said first property being selected from the group consisting of surface planarity and thickness of said top layer, and said element having at least one second property that alters light refraction and light reflection provided by at least one of said photothermographic emulsion layer, said top layer, and said support layer, said second property being a second spatial frequency of variations that is a frequency at least two times higher than said first spatial frequency, said second property being provided at least in part by at least one feature selected from the group consisting of a) the inclusion of particulates other than silver salts of organic acids, b) acutance dyes in said photothermographic emulsion layer, c) haze in said photothermographic emulsion layer, and d) a primer layer on said support layer that has an index of refraction intermediate the index of refraction of said support layer and said photothermographic emulsion layer.

17. A process for the exposure of an imageable element comprising the steps of:

a) exposing the element of claim 1 to coherent radiation to which said silver halide grains are sensitive to generate a latent image, b) heating said element after exposure to develop said latent image to a visible image which is free of any visually observable woodgrain pattern.

18. A spectrally sensitized photothermographic silver halide element comprising a transparent support layer having on at least one surface thereof a photothermographic emulsion layer having a total uniform thickness of from 10 to 40 nm, said thickness having no variation greater than 10 to 200 nm, said photothermographic emulsion layer comprising a binder, a light insensitive silver source, a reducing agent for silver ion, and radiation sensitive silver halide grains, which photothermographic layer displays uniform image density across its surface when exposed to floodlight or uniform incandescent light exposure at a wavelength exposure which the photothermographic emulsion layer is sensitive, and said element displaying less than 0.05 variation in average optical density between adjacent areas of 1 mm2 when said element is uniformly exposed over its entire surface to coherent radiation to which said element is spectrally sensitive, said photothermographic element including a top layer having a uniform thickness of from 0.5 to 6 $\mu$m, wherein said photothermographic emulsion layer and top layer have been applied to said transparent support layer simultaneously using a machine coating apparatus.

19. The element of claim 18 wherein said element is spectrally sensitized to the infrared region of the elctromagnetic spectrum.

20. The element of claim 18 wherein said element is spectrally sensitized to the red region of the elctromagnetic spectrum.

21. The element of claim 18 wherein said element is spectrally sensitized to the visible region of the electromagnetic spectrum.

22. The element of claim 18 wherein said top layer has a random refractive pattern in its surface.

23. The element of claim 22 wherein said refractive pattern reduces optical interference patterns in said photothermographic element upon exposure and development.

24. The element of claim 18 wherein said top layer contains particles which diffuse coherent radiation striking the surface of the element.

25. The element of claim 18 wherein said photothermographic emulsion layer contains light-insensitive particles which add haze to said photothermographic layer.

26. The element of claim 18 wherein said element further comprises a support layer and a surface of said support layer facing said photothermographic layer has a surface which does not uniformly reflect coherent radiation off said surface.

27. The element of claim 18 wherein said element further comprises a support and a surface of said support facing said photothermographic layer is textured to prevent uniform reflection of coherent radiation off said surface.

28. The element of claim 18 wherein said element further comprises a support and a surface of said support facing said photothermographic layer has polymeric particles on said surface.

29. The element of claim 18 wherein said element further comprises a support and a surface of said support facing said photothermographic layer has a primer layer thereon which has an index of refraction intermediate the index of refraction of said support and the index of refraction of said photothermographic layer.

30. A spectrally sensitized photothermographic silver halide emulsion comprising a transparent support layer having on at least one surface thereof a photothermographic emulsion layer having a total uniform thickness of from 10 to 40 $\mu$m, said thickness having no variation greater than 10 to 200 nm, said photothermographic emulsion layer comprising a binder, a light insensitive silver source, a reducing agent for silver ion, and radiation sensitive silver halide grains, which photothermographic element displays uniform image density across its surface of less than 0.05 variation in average optical density between linearly adjacent areas in the form of squares of 1 $cm^2$ when exposed to floodlight or uniform incandescent light exposure at a wavelength of radiation to which the photothermographic emulsion layer is sensitive, said photothermographic element including a top layer having a uniform thickness of from 0.5 to 6 $\mu$m, said top layer having a variation in property selected from the group consisting of thickness and surface smoothness in said top layer, which thickness or surface smoothness has a first spatial frequency, and said element having at least one additional feature that has as second spatial frequency that is higher than said first spatial frequency, said additional feature being selected from the group consisting of 1) physical structure on any surface of said photothermographic emulsion layer or said top layer, and physical structure on a face of said transparent support layer facing said photothermographic emulsion layer, which physical structure alters the refraction and/or reflection characteristics of radiation passing through said surface and 2) haze within a layer between the surface of the top layer and a surface of said transparent support layer facing said photothermographic emulsion layer, wherein said photothermographic emulsion layer and top layer have been applied to said transparent support layer simultaneously using a machine coating apparatus.

31. A spectrally sensitized photothermographic silver halide element comprising a transparent organic polymeric layer having on at least one surface thereof a photothermographic composition that displays uniform image density across its surface of less than 0.05 variation in average optical density between linearly adjacent areas in the form of squares of 1 $cm^2$ when exposed to floodlight or uniform incandescent light exposure at a wavelength of radiation to which the composition layer is sensitive, said composition layer comprising at least two layers, including a top layer having a uniform thickness of from 0.5 to 6 $\mu$m, and a photothermographic emulsion layer having a total uniform thickness of from 10 to 40 $\mu$m, said thickness having no variation greater than 10 to 200 nm, said photothermographic composition layer, said photothermographic emulsion layer comprising a binder, a light insensitive silver source, a reducing agent for silver ion, and radiation sensitive silver halide grains, wherein said photothermographic emulsion layer and top layer have been applied to said transparent support layer simultaneously using a machine coating apparatus, and wherein:

1) the reflective characteristics of a surface of said transparent support layer facing the photothermographic emulsion layer have been altered to reduce reflection of coherent radiation into said photothermographic emulsion layer, and optionally,
2) said element having dyes therein that absorb said radiation to which said photothermographic emulsion layer is sensitive,
3) the top layer of the element has haze induced therein of 0.05 to 30%,
4) there is a random refractive pattern on the top layer, and/or
5) there is haze in the photothermographic emulsion layer caused by optically transparent particulates.

32. A spectrally sensitized photothermographic silver halide element comprising a transparent support layer having on at least one surface thereof a photothermographic emulsion layer having a total uniform thickness of from 10 to 40 $\mu$m, said thickness having no variation greater than 10 to 200 nm, said photothermographic emulsion layer comprising a binder, a light insensitive silver source, a reducing agent for silver ion and radiation sensitive preformed silver halide grains, which element displays uniform image density across its surface when exposed to floodlight or uniform incandescent light exposure at a wavelength of radiation to which the photothermographic emulsion layer is sensitive, said uniform image density meaning a variation in optical density of no more than 5% at a gray out optical density of from 1.5 to 1.9 between adjacent areas of 1 m2 of said photothermographic emulsion layer surface, said photothermographic element comprising at least two layers, including a top layer having a uniform thickness of from 0.5 to 6 $\mu$m, and said photothermographic emulsion layer, wherein said at least two layers have been applied to said transparent support layer simultaneously using a machine coating apparatus, and wherein:

1) the top layer of the element has haze induced-therein of 0.05 to 30%,
2) there is a random refractive pattern on the top layer,
3) there is haze in the photothermographic emulsion layer caused by optically transparent particulates,
4) the reflective characteristics of a surface of the support layer facing the photothermographic emulsion layer have been altered to reduce reflection of coherent radiation into said emulsion layer, or
5) said element having acutance dyes in said photothermographic emulsion layer that absorb radiation to which said photothermographic emulsion layer is sensitive.

33. The photothermographic silver halide element of claim 32 wherein said radiation sensitive preformed silver halide grains have a number average size of between 0.01 and 0.08 Jim.

34. The photothermographic silver halide element of claim 32 wherein said radiation sensitive preformed silver halide grains are iridium-doped silver halide grains.

* * * * *